US007708390B2

(12) United States Patent
Ogawa et al.

(10) Patent No.: US 7,708,390 B2
(45) Date of Patent: May 4, 2010

(54) METHOD OF WORKING SMALL RECESS PORTION, METHOD OF FABRICATING LIQUID EJECTION HEAD AND LIQUID EJECTION HEAD

(75) Inventors: Hideyuki Ogawa, Nagano-ken (JP); Koichi Saito, Nagano-ken (JP); Nagamitsu Takashima, Nagano-ken (JP); Katsunori Ono, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 50 days.

(21) Appl. No.: 12/053,456

(22) Filed: Mar. 21, 2008

(65) Prior Publication Data

US 2008/0174641 A1 Jul. 24, 2008

Related U.S. Application Data

(62) Division of application No. 11/225,052, filed on Sep. 14, 2005, now Pat. No. 7,546,757.

(30) Foreign Application Priority Data

Sep. 14, 2004 (JP) ..... 2004-266322

(51) Int. Cl.
*B41J 2/045* (2006.01)

(52) U.S. Cl. ..... 347/71

(58) Field of Classification Search ..... 347/71
See application file for complete search history.

(56) References Cited

U.S. PATENT DOCUMENTS

2004/0107759 A1 6/2004 Akahane et al.

FOREIGN PATENT DOCUMENTS

JP 2004-98165 A 4/2004

*Primary Examiner*—Matthew Luu
*Assistant Examiner*—Lisa M Solomon
(74) *Attorney, Agent, or Firm*—Sughrue Mion, PLLC

(57) ABSTRACT

The invention is directed to a method of working a small recess portion. In the method, prior to press-forming small recess portions arrayed in a row by pressing a predetermined number of pieces of aligned male dies to a metal base plate, the metal base plate is previously formed with a highly rigid portion at a predetermined portion at a vicinity of an imaginary line extending in a row direction along end portions of predicted press portions to which the respective male dies are pressed.

5 Claims, 28 Drawing Sheets

METHOD OF WORKING SMALL RECESS PORTION, METHOD OF FABRICATING LIQUID EJECTION HEAD AND LIQUID EJECTION HEAD

CROSS-REFERENCE TO RELATED APPLICATIONS

This is a divisional of application Ser. No. 11/225,052 filed Sep. 14, 2005. Priority is claimed from JPA 2004-266322 filed Sep. 14, 2004. The entire disclosures of the prior application, application Ser. No. 11/225,052, and the above-identified priority document, are hereby incorporated by reference.

BACKGROUND OF THE INVENTION

The present invention relates to a method of working a small recess portion utilized in fabricating a part of a liquid ejection head or the like and a method of fabricating a liquid ejection head and a liquid ejection head.

Forging is utilized in various product fields, for example, it is known that a pressure generating chamber of a liquid ejection head is formed by forging a metal material. The liquid ejection head is for ejecting a pressurized liquid from a nozzle opening as liquid drops and there is known a liquid ejection head constituting an object by various liquids. As a representative one among them, an ink jet recording head can be pointed out. Hence, an explanation will be given of a background art by taking an example of the ink jet recording head.

The ink jet type recording head (hereinafter, referred to as recording head) is provided with a plurality of a series of flow paths reaching nozzle openings from a common ink chamber via pressure generating chambers in correspondence with the nozzle openings. Further, in view of a request for small-sized formation, it is necessary to form the respective generating chambers by a fine pitch in correspondence with a recording density. Therefore, a wall thickness of a partition wall portion for partitioning the contiguous pressure generating chambers becomes extremely thin. Further, a flow path width of an ink supply port communicating the pressure generating chamber and the common ink chamber is further narrowed more than that of the pressure generating chamber in order to efficiently use an ink pressure in the pressure generating chamber for delivering ink drops.

Further, a nozzle plate formed with the nozzle opening is fabricated by a metal plate in view of a request for workability or the like. Further, a diaphragm portion for changing a volume of the pressure generating chamber is formed by an elastic plate. The elastic plate is constituted by a double structure of pasting a resin film onto a support plate made of a metal and is fabricated by removing a portion of the support plate in correspondence with the pressure generating chamber.

Patent Reference 1: JP-A-2004-98165

Meanwhile, according to the above-described recording head of the background art, the pressure generating chamber is constituted by a groove-like recess portion aligned at a pressure generating chamber forming plate made of a metal by pressing or the like. The groove-like recess portion is formed as a small recess portion, a width of the groove is very narrow, further, a wall thickness of a partition wall portion for partitioning the groove-like recess portions is extremely thin and therefore, utmost caution is paid in accurately providing a recess shape of the pressure generating chamber. Particularly, it is important for making volumes of the respective pressure generating chambers uniform to align end portions of the groove-like recess portions on an imaginary line having a predetermined shape. Since the groove-like recess portion is the very small recess portion as described above, a variation is generated in the shape of the groove-like recess portion by a flowing phenomenon of a metal material in working or other working conditions, and it seems that a problem is posed in the above-described aligned state on the imaginary line.

SUMMARY OF THE INVENTION

The invention has been carried out in order to resolve the problem and it is an object thereof to provide a method of working a small recess portion capable of regularly disposing end portions of the small recess portions on an imaginary line having a predetermined shape in forming a highly accurate recess portion shape by forging and a method of fabricating a liquid ejection head and a liquid ejection head.

In order to achieve the above-described object, a method of working a small recess portion of the invention constitutes a gist thereof by that prior to pressing small recess portions in a row-like shape by pressing a predetermined number of pieces of aligned male dies to a metal base plate, the metal base plate is previously formed with a highly rigid portion at a predetermined portion at a vicinity of an imaginary line extended in a row direction along end portions of portions predicted to be pressed to which the respective male dies are pressed.

Further, in order to achieve the above-described object, a method of fabricating a liquid ejection head of the invention constitutes a gist thereof by a method of fabricating a liquid ejection head comprising a pressure generating chamber forming plate made of a metal formed with groove-like recess portions aligned in parallel with each other and formed with a communication port penetrated in a plate thickness direction at one end of each of the groove-like recess portions, a nozzle plate made of a metal bored with a nozzle opening at a position thereof in correspondence with the communication port, and a sealing plate made of a metal for sealing an opening face of the groove-like recess portion and bored with a liquid supply port at a position thereof in correspondence with other end of the groove-like recess portion, and constituted by bonding the sealing plate to a side of the groove-like recess portion of the pressure generating chamber and bonding the nozzle plate to an opposed side, respectively, wherein prior to pressing the groove-like recess portions in a row-like shape by pressing a predetermined number of pieces of aligned male dies to a metal board, the metal board is previously formed with a highly rigid portion at a predetermined portion at a vicinity of an imaginary line extended in a row direction along end portions of portions predicted to be pressed to which the respective male dies are pressed.

Further, in order to achieve the above-described object, a liquid ejection head of the invention constitutes a gist thereof by a pressure generating chamber forming plate made of a metal formed with groove-like recess portions aligned in parallel with each other and formed with a communication port penetrated in a plate thickness direction at one end of each of the groove-like recess portions, a nozzle plate made of a metal bored with a nozzle opening at a position thereof in correspondence with the communication port, and a sealing plate made of a metal for sealing an opening face of the groove-like recess portion and bored with a liquid supply port at a position thereof in correspondence with other end of the groove-like recess portion and constituted by bonding the sealing plate to a side of the groove-like recess portion of the pressure generating chamber forming plate and bonding the nozzle plate to an opposed side, respectively, wherein the pressure generating chamber forming plate is provided with a highly rigid portion at a predetermined portion at a vicinity of an imaginary line extended in a row direction along end portions of the groove-like recess portions in a row-like shape.

That is, according to a method of working a small recess portion of the invention, there is set the imaginary line extended in the row direction along the end portions of the portions predicted to be pressed to which the predetermined number of pieces of the aligned male dies are pressed, the highly rigid portion is previously formed at a vicinity of the imaginary line, thereafter, the male dies are pressed to the metal board and therefore, flow of a metal material in a transient state of forming the small recess portion is restrained by the highly rigid portion, and the end portions of the small recess portions are formed in the state of being aligned regularly along the imaginary line. Therefore, it can easily be achieved to form the extremely small recess portions which are made to be difficult to promote a forming accuracy in the state of aligning a number of the small recess portions on the imaginary line having the predetermined shape. According to the advantage, a shape of the recess portion and a volume of the recess portion of the small recess portion can be provided as predetermined values, for example, the advantage is extremely preferable when, for example, the pressure generating chamber of the liquid ejection head is constituted by pressing.

In the method of working a small recess portion of the invention, when the highly rigid portion is a portion set such that a portion of a region along the imaginary line of the metal board constitutes the rigidity relatively higher than that of the other portion, the relatively high rigid portion may be formed along the imaginary line and therefore, formation of the highly rigid portion can be carried out extremely simply. That is, the highly rigid portion may be formed by increasing the rigidity at a predetermined portion and making a rigidity of other portion stay as it is or lowering the rigidity, further, the highly rigid portion may be formed by lowering the rigidity of the predetermined portion and making the rigidity of other portion stay as it is or increasing the rigidity and the highly rigid portion can simply be provided in this way.

In the method of working a small recess portion of the invention, when the highly rigid portion is provided in the recess groove portion formed along the imaginary line, simultaneously with forming the recess groove portion, the highly rigid portion can be formed in the recess groove portion and therefore, a step of forming the highly rigid portion is simplified. Further, the recess groove portion is arranged along the imaginary line and therefore, it is facilitated to arrange the highly rigid portion formed in the recess groove portion at a predetermined position and proper formation of the position relative to the imaginary line is facilitated to execute.

In the method of working a small recess portion of the invention, when the highly rigid portion is a shallow bottom portion formed by shallowing a depth of a portion of the recess groove portion, a wall thickness of the shallow bottom portion becomes larger than that of other portion and therefore, a function as the highly rigid portion is achieved. Further, the highly rigid portion is formed by only shallowing the depth of the recess groove portion and therefore, working is simplified by simple pressing.

In the method of working a small recess portion of the invention, when the highly rigid portion is a narrow width portion formed by narrowing a width of a portion of the recess groove portion, by working to narrow the width of the narrow recess portion, an amount of making the metal material flow in the narrow width direction becomes smaller than that of a portion of other recess groove portion and therefore, as a result, the groove-like recess portions are aligned on the imaginary line. In the method of working a small recess portion of the invention, when the high rigid portion is an unopened portion formed by providing an opening portion at a bottom portion of the recess groove portion, in forming the recess groove portion, the opening portion can be formed by a simple pressing step and therefore, the unopened portion constituting the highly rigid portion can simply be worked.

In the method of working a small recess portion of the invention, when the highly rigid portion is provided at a vicinity of a row end of the portions predicted to be pressed in a row-like shape to which the respective male dies are pressed, although it seems that the alignment of the small recess portions formed at the vicinity of the row end is liable to be brought into an abnormal mode by a state of making the metal material flow at a vicinity of the lower end of the male dies, a pressing condition or the like, the highly rigid portion is arranged to be adapted to a portion which is liable to show the abnormality in this way and therefore, the abnormal mode can be restrained from being brought about.

In the method of working a small recess portion of the invention, when the imaginary line is substantially a linear line, the end portions of the small recess portions can be aligned accurately along the imaginary linear line and shapes of the small recess portions and volumes of the recess portions are facilitated to be provided uniformly. In the method of working a small recess portion of the invention, when the small recess portions are groove-like recess portions aligned in parallel with each other, the metal material can be retrained from flowing in the longitudinal direction of the groove-like recess portions by the highly rigid portion and the end portions of the groove-like recess portions can be formed accurately along the imaginary line.

Further, according to the method of fabricating a liquid ejection head of the invention, prior to forming the small groove-like recess portions at the metal board in the aligned state, the metal board is previously formed with the highly rigid portion at a predetermined portion at a vicinity of the imaginary line extended in the row direction along the end portions of the portions predicted to be pressed to which the respective male dies are pressed and therefore, flow of the metal material in a transient stage of forming the groove-like recess portion is restrained by the highly rigid portion, the end portions of the groove-like recess portions are formed in the state of being aligned regularly along the imaginary line. Therefore, it can easily be achieved to form a number of the extremely small groove-like recess portions which are made to be difficult to promote a forming accuracy in the state of being aligned on the imaginary line in the predetermined shape. Therefore, shapes and volumes of the respective pressure generating chambers of the liquid ejection head can uniformly be set and the characteristic of ejecting a liquid can be stabilized.

Further, according to the liquid ejection head of the invention, the pressure generating chamber forming plate is provided with the highly rigid portion at a predetermined portion of a vicinity of the imaginary line extended in the row direction along the end portions of the groove-like recess portion in the row-like shape and therefore, there is provided the groove-like recess portion in which flow of the metal material in forming is restrained by the highly rigid portion, the shapes and the volumes of the respective pressure generating chambers of the liquid ejection head can be set to be uniform and the characteristic of ejecting a liquid can be stabilized.

The present disclosure relates to the subject matter contained in Japanese patent application No. 2004-266322 (filed on Sep. 14, 2004), which is expressly incorporated herein by reference in its entirety.

DESCRIPTION OF THE PREFERRED EMBODIMENT

An explanation will be given of the best mode for embodying a method of working a small recess portion, a method of fabricating a liquid ejection head and a liquid ejection head according to the invention as follows.

A method of working a small recess portion according to the invention can preferably be utilized in fabricating a part of a liquid ejection head and therefore, in illustrated embodiments, as a representative case of a liquid ejection head, there is shown an example of applying the method of working a small recess portion in fabricating a part of an ink jet type recording head.

Embodiment 1

Figure 1:
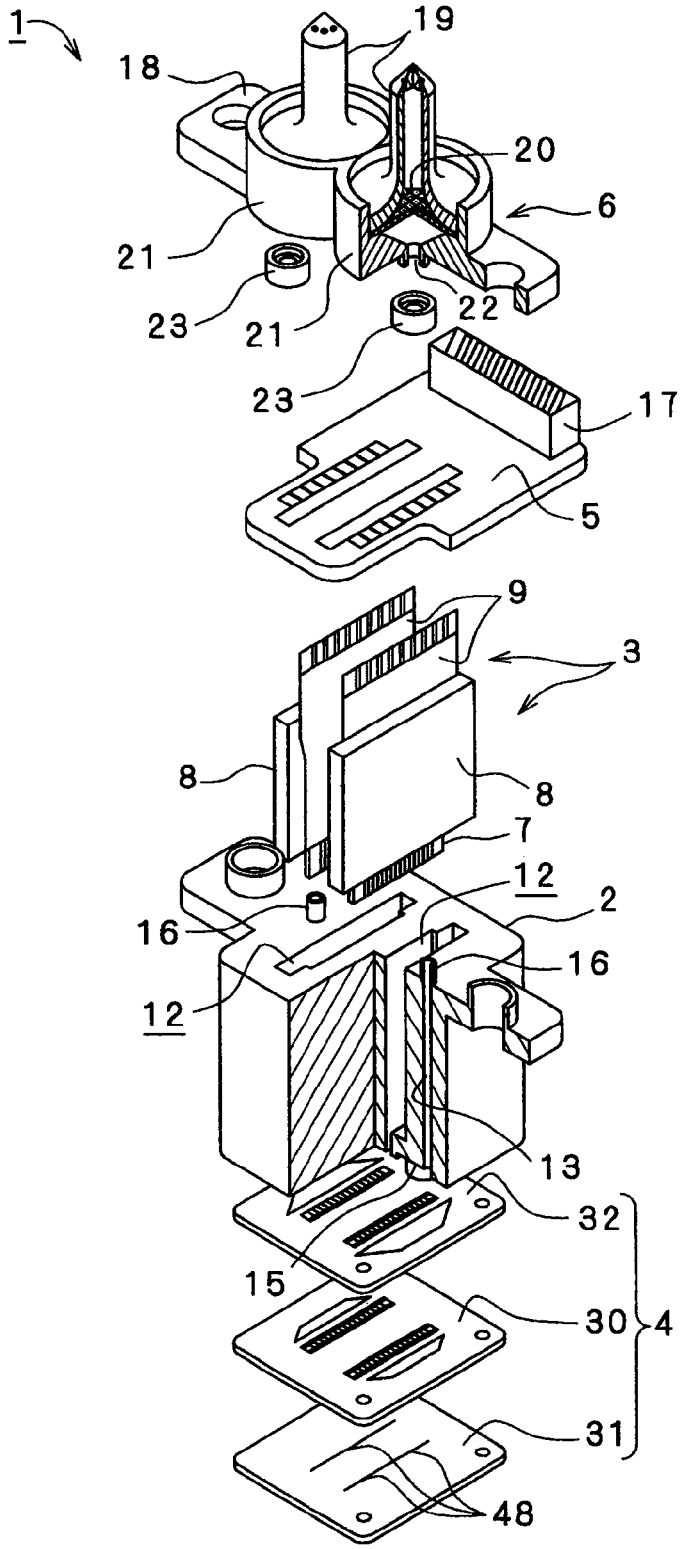
FIG. 1 is a disassembled perspective view of an ink jet type recording head.
Figure 2:
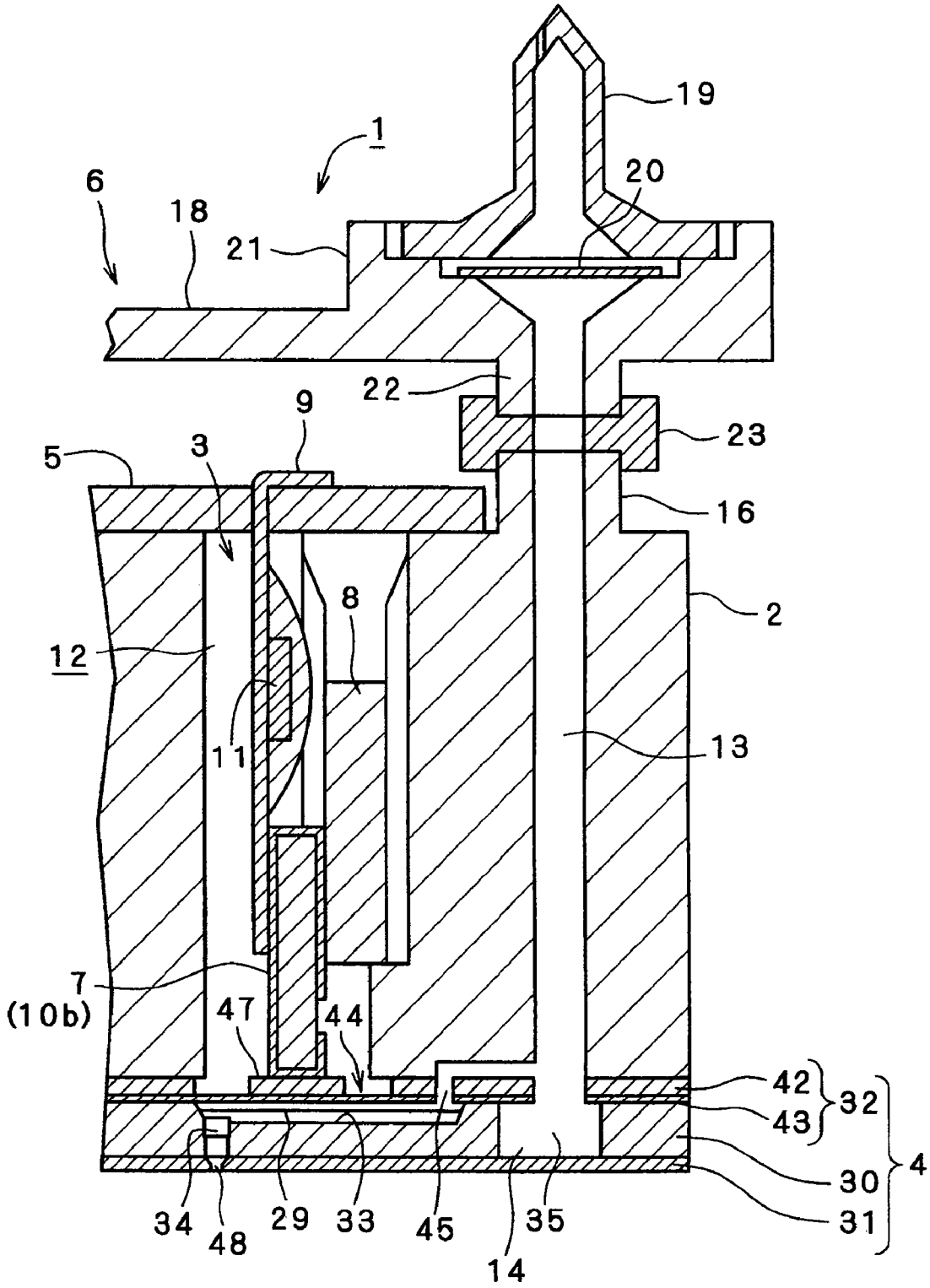
FIG. 2 is a sectional view of the ink jet type recording head.

As shown by FIG. 1 and FIG. 2, a recording head 1 is substantially constituted by a case 2, an oscillator unit 3 contained in the case 2, a flow path unit 4 bonded to a front end face of the case 2, a connection board 5 arranged on an attaching face of the case 2 on a side opposed to the front end face, a supply needle unit 6 attached to a side of the attaching face of the case 2 and the like.

Figure 3:
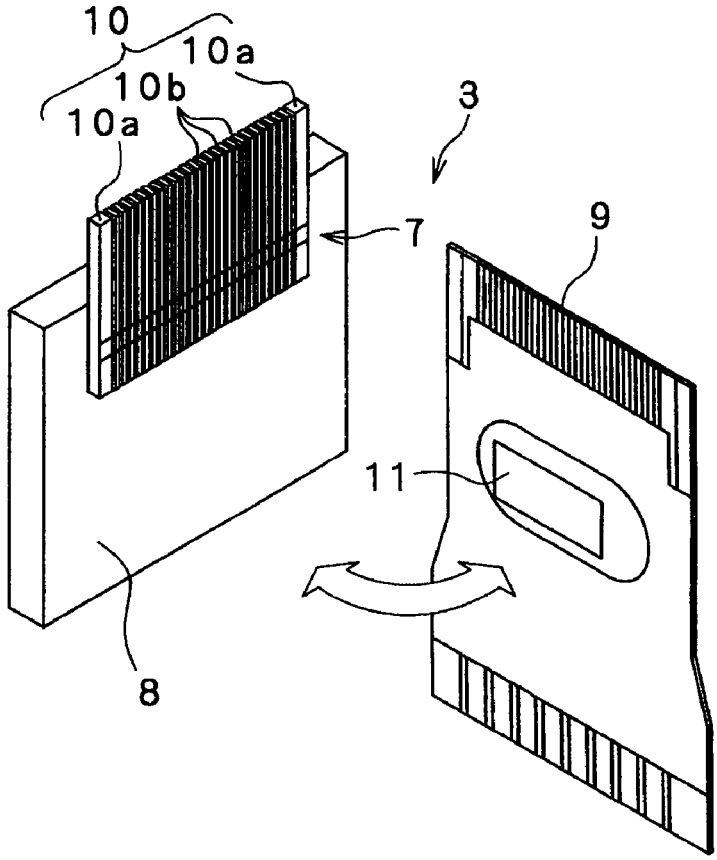
FIGS. 3(*a*) and (*b*) are views for explaining an oscillator unit
Figure 3:
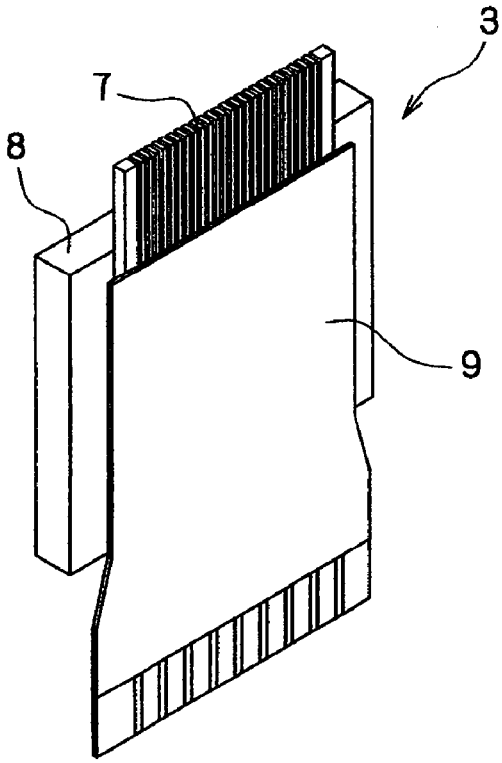

As shown FIG. 3, the oscillator unit 3 is substantially constituted by a piezoelectric oscillator group 7, a fixed plate 8 bonded with the piezoelectric oscillator group 7, and a flexible cable 9 for supplying a drive signal to the piezoelectric oscillator group 7.

The piezoelectric oscillator group 7 is provided with a plurality of piezoelectric oscillators 10 . . . formed in a row-like shape. The respective piezoelectric oscillators 10 . . . are a kind of pressure generating elements and is also a kind of electromechanical conversion elements. The respective electric oscillators 10 . . . are constituted by a pair of dummy oscillators 10*a*, 10*a* disposed at both ends of the row and a plurality of driving oscillators 10*b* . . . arranged between the dummy oscillators 10*a*, 10*a*. Further, the respective driving oscillators 10*b* are cut to be divided in a combteeth-like shape having an extremely slender width of, for example, about 50 μm through 100 μm and provided by 180 pieces. Further, the dummy oscillator 10*a* is provided with a width sufficiently larger than that of the driving oscillators 10*b* and is provided with a protecting function for protecting the driving oscillator 10*b* against impact or the like and a guiding function for disposing the oscillator units 3 at predetermined positions.

According to the respective piezoelectric oscillators 10 . . . , free end portions thereof are projected to a side outward from a front end face of the fixed plate 8 by bonding fixed end portions thereof onto the fixed plate 8. That is, the respective piezoelectric oscillators 10 . . . are supported on the fixed plate 8 in a so-to-speak cantilever state. Further, the free end portions of the respective piezoelectric oscillators 10 . . . are constituted by alternately laminating piezoelectric members and inner electrodes and are elongated and contracted in a longitudinal direction of the elements by applying a potential difference between the electrodes opposed to each other.

The flexible cable 9 is electrically connected to the piezoelectric oscillators 10 at side faces of fixed end portions thereof constituting a side opposed to the fixed plate 8. Further, a surface of the flexible cable 9 is mounted with a controlling IC 11 for controlling to drive the piezoelectric oscillators 10. Further, the fixed plate 8 for supporting the respective piezoelectric oscillators 10 . . . is a plate-like member having a rigidity capable of receiving a reaction force from the piezoelectric oscillator 10 and a metal plate of a stainless steel plate or the like is preferably used therefor.

The case 2 is a block-like member molded by a thermoplastic resin of, for example, epoxy species resin or the like. Here, the reason of molding the case 2 by a thermoplastic resin is that the thermoplastic resin is provided with a mechanical strength higher than that of a general resin, a linear expansion coefficient thereof is smaller than that of a general resin and deformation by a change in a temperature of a surrounding is smaller. Further, inside of the case 2 is formed with a containing hollow portion 12 capable of containing the oscillators unit 3, and an ink supply path 13 constituting a portion of a flow path of ink.

The containing hollow portion 12 is a hollow portion having a size capable of containing the oscillator unit 3. At a portion on a front end side of the containing hollow portion 12, an inner wall of the case is partially projected to direct in a side direction and an upper face of the projected portion functions as a face in contact with the fixed plate. Further, the oscillator unit 3 is contained in the containing hollow portion 12 in a state of facing front ends of the respective piezoelectric oscillators 10 from an opening thereof. In the containing state, a front end face of the fixed plate 8 is adhered thereto in a state of being brought into contact with the face in contact with the fixed plate.

A front end recess portion 15 is fabricated by partially recessing a front end face of the case 2. The front end recess portion 15 of the embodiment is a recess portion substantially in a trapezoidal shape formed on left and right outer sides of the containing hollow portion 12 and is formed such that a lower bottom of the trapezoid is disposed on a side of the containing hollow portion 12.

The ink supply path 13 is formed to penetrate in a height direction of the case 2 and a front end thereof is communicated with an ink storing chamber 14, mentioned later. Further, an end portion of the ink supply path 13 on a side of the attaching face is formed in a connection port 16 projected from the attaching face.

The connection board 5 is a wiring board formed with electric wirings for various signals supplied to the recording head 1 and attached with a connector 17 capable of connecting a signal cable. Further, the connection board 5 is arranged on the attaching face of the case 2 and is connected with an electric wiring of the flexible cable 9 by soldering or the like. Further, the connector 17 is inserted with a front end of a signal cable from a control apparatus (not illustrated).

The supply needle unit 6 is a portion connected with an ink cartridge (not illustrated) and is substantially constituted by a needle holder 18, an ink supply needle 19, and a filter 20.

The ink supply needle 19 is a portion inserted into the ink cartridge for introducing ink stored in the ink cartridge. A front end portion of the ink supply needle 19 is sharpened in a conical shape to facilitate to insert into the ink cartridge. Further, the front end portion is bored with a plurality of ink introducing holes for communicating inside and outside of the ink supply needle 19. Further, the recording head 1 of the embodiment can eject two kinds of inks and therefore, the recording head 1 is provided with two pieces of the ink supply needles 19.

The needle holder 18 is a member for attaching the ink supply needle 19 and a surface thereof is formed with two pieces of base seats 21 for fixedly attaching root portions of the ink supply needles 19 to align transversely. Further, a substantial center of a seat bottom face is formed with an ink discharge port 22 penetrated in a plate thickness direction of the needle holder 18. Further, a flange portion is extended in a side direction in the needle holder 18.

The filter 20 is a member for hampering a foreign matter in ink of dust, burrs in molding or the like from passing and is constituted by, for example, a metal net having a fine mesh. The filter 20 is adhered to a filter holding groove formed in the base seat 21.

Further, as shown by FIG. 2, the supply needle unit 6 is arranged on the attaching face of the case 2. In the arranged state, the ink discharge port 22 of the supply needle unit 6 and the connection port 16 of the case 2 are communicated in a liquid tight state via a packing 23.

Next, the flow path unit 4 will be explained. The flow path unit 4 is constituted to bond a nozzle plate 31 to one face of a pressure generating chamber forming plate 30 and bond an elastic plate 32 to other face of the pressure generating chamber 30.

Figure 4:
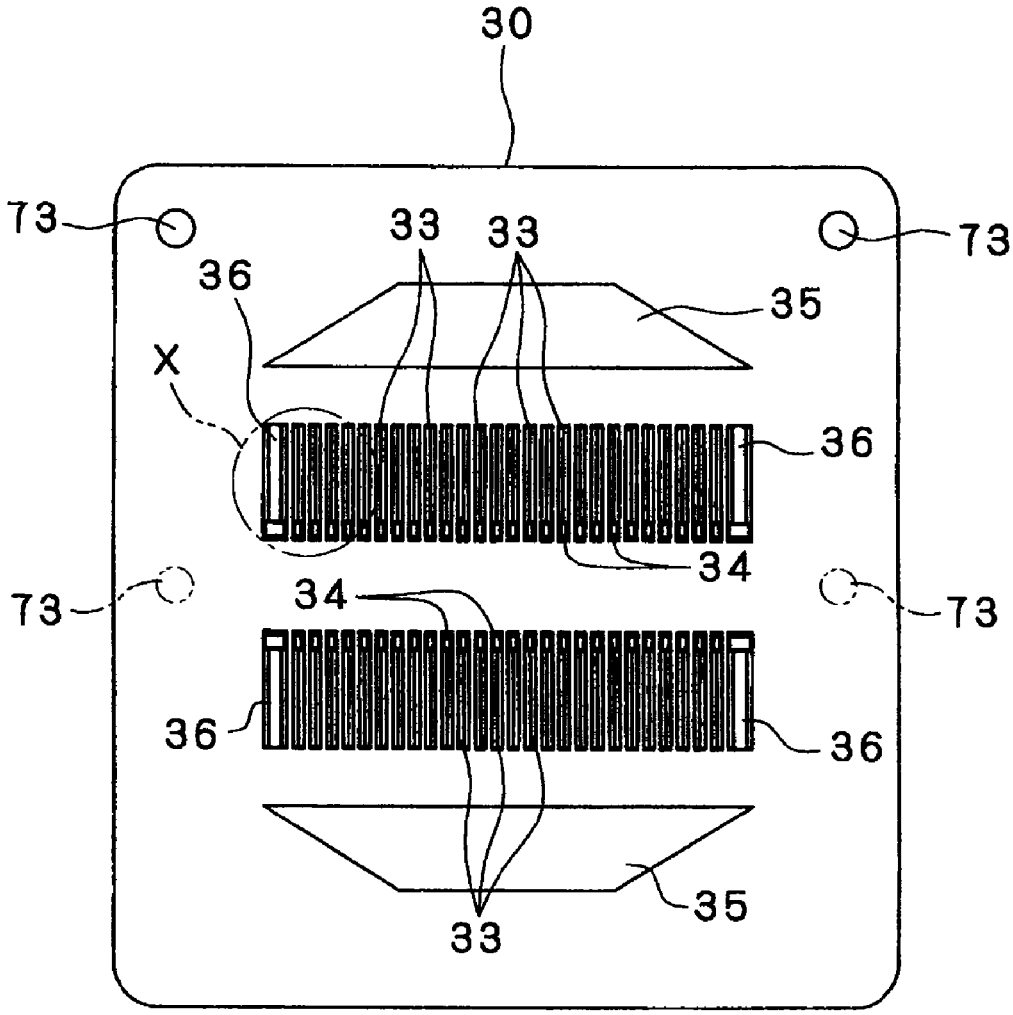
FIG. 4 is a plane view of a pressure generating chamber forming plate.

As shown by FIG. 4, the pressure generating chamber forming plate 30 is a plate-like member made of a metal formed with a groove-like recess portion 33 a number of which are aligned in parallel in a longitudinal direction, a communication port 34 provided at each groove-like recess portion 33 and a space for chamber (hereinafter, referred to as reservoir) 35 for forming an ink storing chamber 14. The pressure generating chamber forming plate 30 is a metal board subjected to pressing. The reservoir 35 is provided in a state of being penetrated in a plate thickness direction of the pressure generating chamber forming plate 30 substantially along a direction of aligning the groove-like recess portions 33 and is constituted by a slender shape extended in the direction of aligning the groove-like recess portions 33. The similar reservoir 35 is illustrated in a punching step also in a view of a step of working the pressure generating chamber forming plate 30, mentioned later. According to the embodiment, the pressure generating chamber forming plate 30 is fabricated by working a board made of nickel having a thickness of 0.35 mm.

Here, reason of selecting nickel as the board will be explained. First reason is that a linear expansion coefficient of nickel is substantially equal to a linear expansion coefficient of a metal constituting principal portions of the nozzle plate 31 and the elastic plate 32. That is, when linear expansion coefficients of the pressure generating chamber forming plate 30, the elastic plate 32 and the nozzle plate 31 constituting the flow path unit 4 are equal, in the case in which the respective members are heated to adhere, the respective members are uniformly expanded. Therefore, it is difficult to generate mechanical stresses of warp or the like caused by a difference in the expansion coefficients. As a result, the respective members can be adhered without a hindrance even when an adhering temperature is set to a high temperature. Further, even when the piezoelectric oscillators 10 generate heat in operating the recording head 1 and the flow path unit 4 is heated by the heat, the respective members 30, 31, 32 constituting the flow path unit 4 are uniformly expanded. Therefore, even when heating by operating the recording head 1 and cooling by stopping to operate the recording head 1 are repeatedly carried out, it is difficult to bring about a drawback of exfoliation or the like in the respective members 30, 31, 32 constituting the flow path unit 4.

A second reason is that nickel is excellent in rust resistance. That is, in the recording head 1 of this kind, an aqueous ink is preferably used and therefore, it is important that denaturing of rust or the like is not brought about even when brought into contact with water over a long period of time. In this respect, nickel is excellent in rust resistance similar to stainless steel and it is difficult to be denatured such as rust or the like.

A third reason is that nickel is rich in malleability. That is, in fabricating the pressure generating chamber forming plate 30, the pressure generating chamber forming plate 30 is fabricated by plastic deformation (for example, pressing) as mentioned later according to the embodiment. Further, the groove-like recess portion 33 and the communication port 34 formed at the pressure generating chamber forming plate 30 are constituted by extremely small shapes and a high dimensional accuracy is requested therefor. Further, when nickel is used for the board, the groove-like recess portion 33 and the communication port 34 can be formed with a high dimensional accuracy even by plastic deformation since nickel is rich in malleability.

Further, the pressure generating chamber forming plate 30 may be constituted by a metal other than nickel or an alloy with nickel so far as the above-described respective conditions, that is, the condition of the linear expansion coefficient, the condition of the rust resistance and the condition of the malleability are satisfied.

Figure 5:
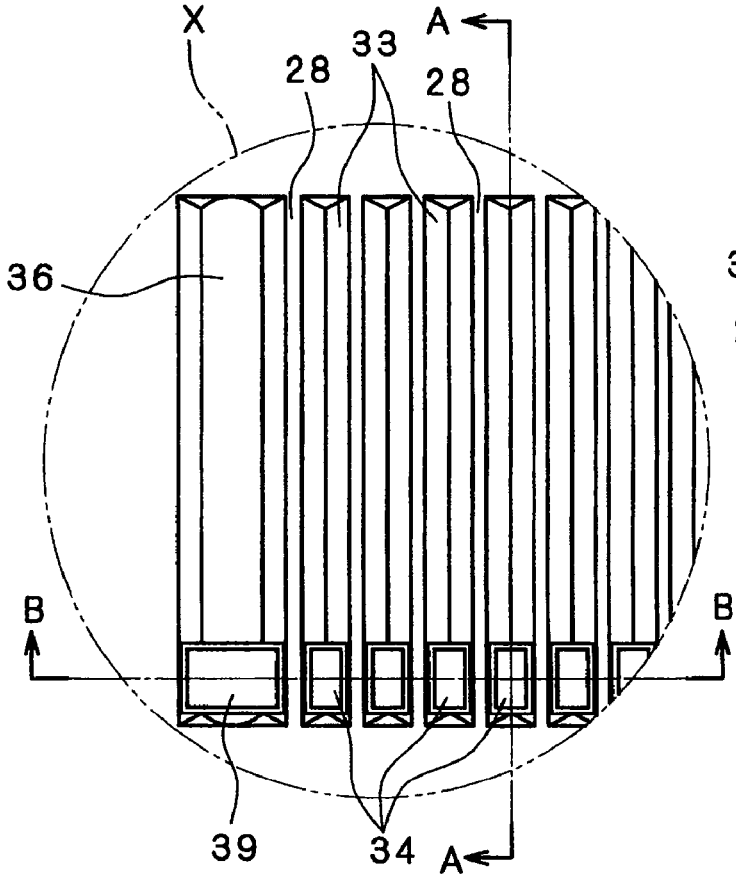
FIG. 5 illustrates explanatory views of the pressure generating chamber forming plate, FIG. 5(*a*) is a view enlarging portion X in FIG. 4, FIG. 5(*b*) is a sectional view taken along a line A-A of FIG. 5(*a*), and FIG. 5(*c*) is a sectional view taken along a line B-B of FIG. 5(*a*)
Figure 5:
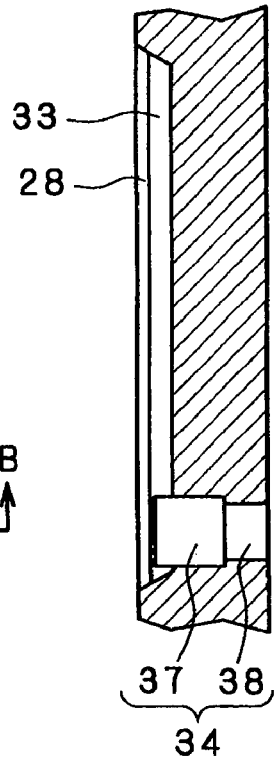
Figure 5:
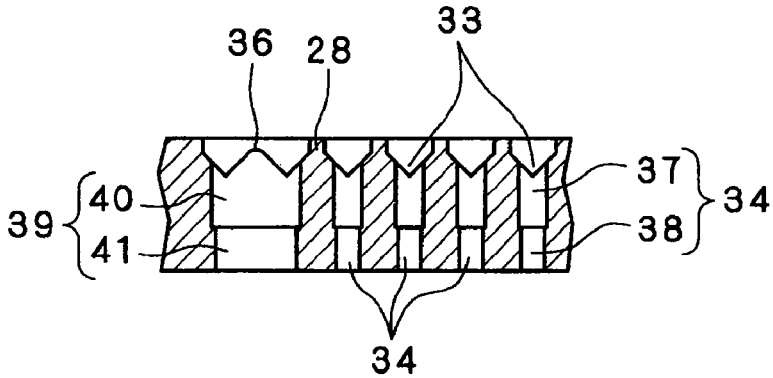
Figure 6:
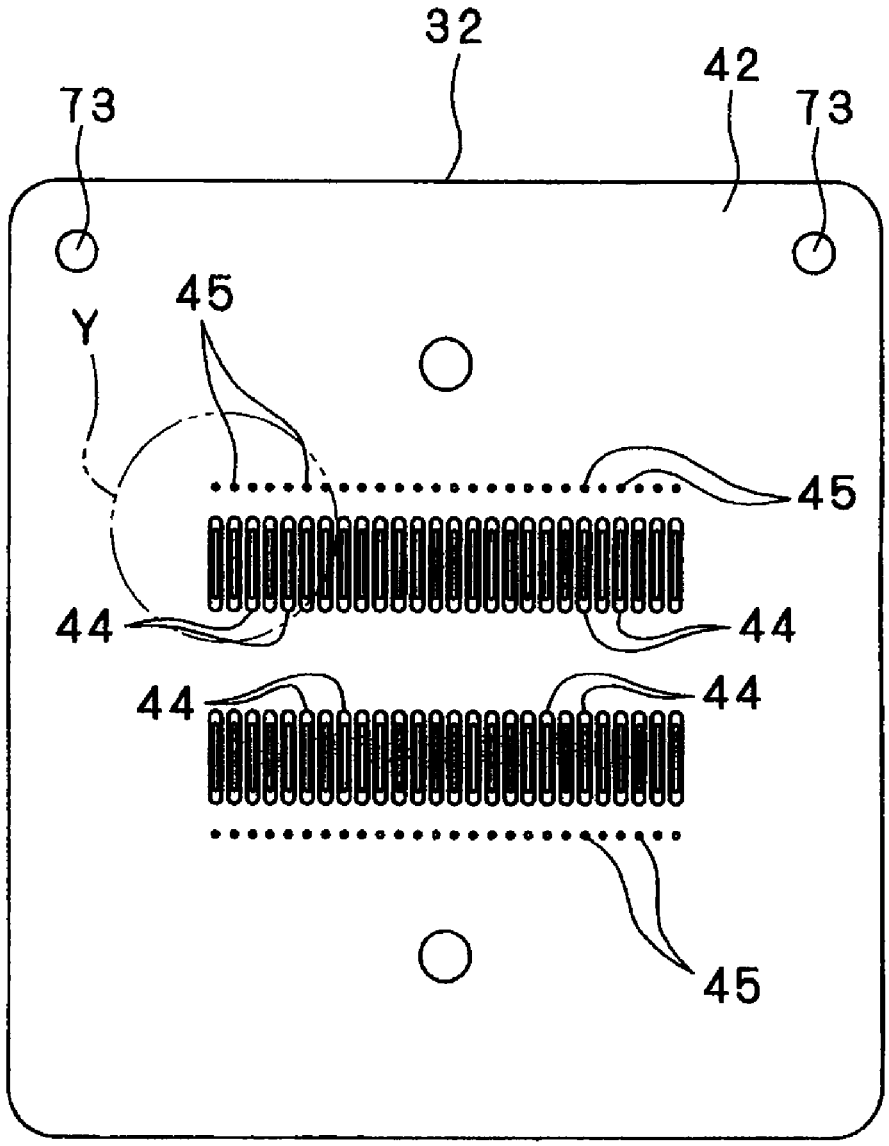
FIG. 6 is a plane view of an elastic plate.

The groove-like recess portion 33 is a recess portion in a shape of a groove for constituting a pressure generating chamber 29, and is constituted by a groove in a linear shape as shown by FIG. 5 by enlarging the groove. According to the embodiment, 180 pieces of grooves of a width of about 0.1 mm, a length of about 1.5 mm, and a depth of about 0.1 mm are aligned in a groove width direction. A width of a bottom face of the groove-like recess portion 33 is contracted to be recessed in a V-like shape as proceeding in a depth direction (that is, depth side). The bottom face is recessed in the V-like shape to promote a rigidity of a partition wall portion 28 for partitioning the pressure generating chambers 29, 29 contiguous to each other. That is, by recessing the bottom face in the V-like shape, a wall thickness of a root portion (portion on bottom face side) of the partition wall portion 28 is thickened and the rigidity of the partition wall portion 28 is promoted. Further, when the rigidity of the partition wall portion 28 is promoted, an influence of a pressure variation from the contiguous pressure generating chamber 29 is difficult to be effected. That is, the variation in the ink pressure from the contiguous pressure generating chamber 29 is difficult to be transmitted. Further, by recessing the bottom face in the V-like shape, the groove-like recess portion 33 can be formed by plastic deformation with an excellent dimensional accuracy (mentioned later). Further, although an angle of the character V is rectified by a working condition, the angle is, for example, around 90 degrees. Further, since the wall thickness of a front end portion of the partition wall portion 28 is extremely thin, even when the pressure generating chambers 29 are densely formed, a necessary volume can be ensured.

Further, with regard to the groove-like recess portion 33 according to the embodiment, both end portions in a longitudinal direction thereof are inclined downward to an inner side as proceeding to the depth side. That is, the both end portions in the longitudinal direction of the groove-like recess portion 33 is formed in a pressed shape. Because by constituting in this way, the groove-like recess portion 33 is formed with an excellent dimensional accuracy by plastic deformation.

Further, ones of the dummy recess portions 36 having a width wider than that of the groove-like recess portion 33 are formed contiguously to the groove-like recess portions 33, 33 at the both end portions. The dummy recess portion 36 is a recess portion in a groove-like shape for constituting a dummy pressure generating chamber which does not relate to ejection of ink drops. The dummy recess portion 36 according to the embodiment is constituted by a groove having a width of about 0.2 mm, a length of about 1.5 mm, and a depth of about 0.1 mm. Further, a bottom face of the dummy recess portion 36 is recessed in a W-like shape. This is for promoting the rigidity of the partition wall portion 28 and forming the dummy recess portion 36 by plastic deformation with an excellent dimensional accuracy.

Further, a row 33*a* of a recess portion in a groove-like shape is constituted by the respective groove-like recess portions 33 . . . and the pair of dummy recess portions 36, 36. According to the embodiment, two rows of the rows 33*a* are formed transversely. That is, a set is constituted by the row 33*a* of the groove-like recess portions and the reservoir 35 and two sets thereof are arranged.

A communication port 34 is formed as a through hole penetrated from one end of the groove-like recess portion 33 in a plate thickness direction. The communication port 34 is formed for each groove-like recess portion 33 and a single recess portion row is formed with 180 pieces thereof. According to the communication port 34 of the embodiment, a shape of an opening thereof is constituted by a rectangular shape and is constituted by a first communication port 37 formed from a side of the groove-like recess portion 33 of the pressure generating chamber forming plate 30 to a middle thereof in a plate thickness direction, and a second communication port 38 formed from a surface thereof on a side opposed to the groove-like recess portion 33 to the middle in the plate thickness direction.

Further, sectional areas of the first communication port 37 and the second communication port 38 differ from each other, and an inner dimension of the second communication port 38 is set to be slightly smaller than an inner dimension of the first communication port 37. This is owing to the fact that the communication port 34 is fabricated by pressing. That is, the pressure generating chamber forming plate 30 is fabricated by working a nickel plate having a thickness of 0.35 mm and therefore, a length of the communication port 34 becomes equal to or larger than 0.25 mm even subtracting the depth of the groove-like recess portion 33. Further, the width of the communication port 34 is set to be less than 0.1 mm since it is necessary to make the width narrower than the groove width of the groove-like recess portion 33. Therefore, when the communication port 34 is going to be punched by one time working, a male die (punch) is buckled in view of a relationship with an aspect ratio. Hence, according to the embodiment, working is divided to two times, in the first working, the first communication port 37 is formed up to the middle in the plate thickness direction and in the second working, the second communication port 38 is formed. Further, a working procedure of the communication port 34 will be explained later.

Further, the dummy recess portion 36 is formed with a dummy communication port 39. Similar to the communication port 34, the dummy communication port 39 is constituted by a first dummy communication port 40 and a second dummy communication port 41 and an inner dimension of the second dummy communication port 41 is set to be smaller than an inner dimension of the first dummy communication port 40.

Further, although according to the embodiment, the communication port 34 and the dummy communication port 39 the opening shape of which is constituted by the rectangular through hole are exemplified, the shape is not limited to the rectangular shape. Further, the opening shape may be constituted by a through hole opened in a circular shape.

Next, the elastic plate 32 will be explained. The elastic plate 32 is a kind of a sealing plate and is fabricated by a composite material (a kind of a metal material of the invention) laminating an elastic film 43 on a support plate 42. According to the embodiment, a stainless steel plate is used as the support plate 42 and PPS (polyphenylene sulfide) is used as the elastic film 43.

Figure 7:
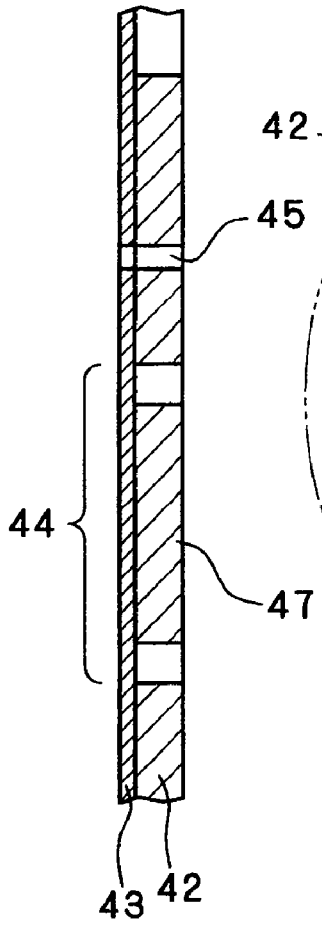
FIG. 7 illustrates explanatory views of the elastic plate, FIG. 7(*a*) is a view enlarging portion Y of FIG. 6, FIG. 7(*b*) is a sectional view taken along a line C-C of FIG. 7(*a*)
Figure 7:
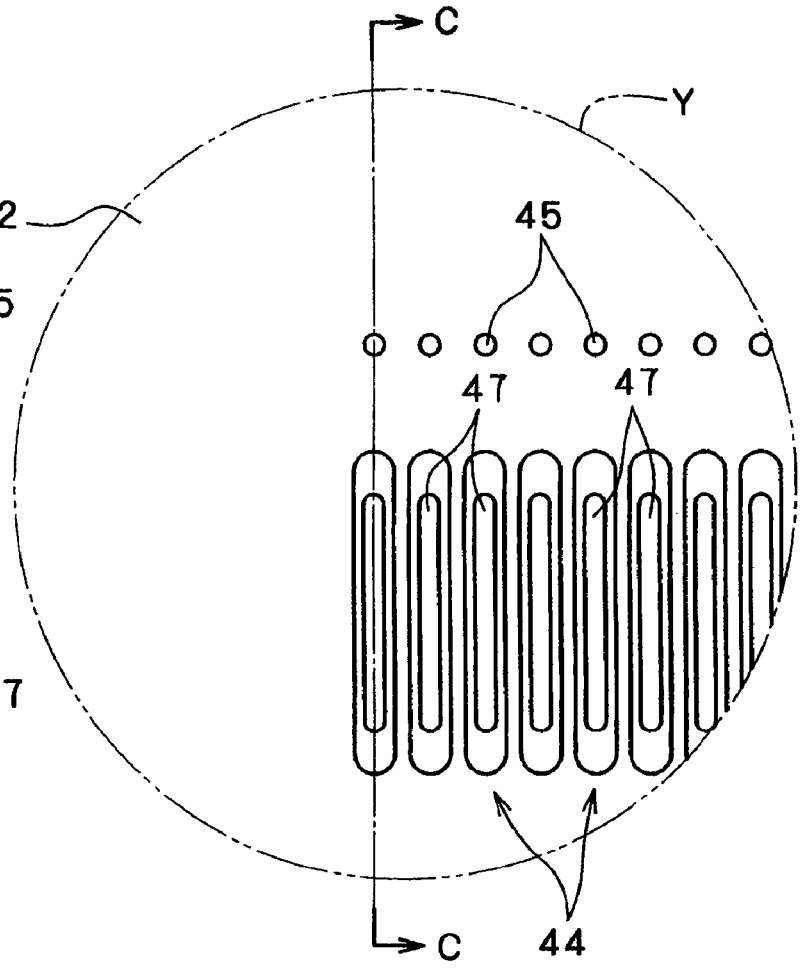

A diaphragm portion 44 is a portion of partitioning a portion of the pressure generating chamber 29. That is, the diaphragm portion 44 seals an opening face of the groove-like recess portion 33 and partition to form the pressure generating chamber 29 along with the groove-like recess portion 33. As shown by FIG. 7(*a*), the diaphragm portion 44 is constituted by a slender shape in correspondence with the groove-like recess portion 33 and is formed for each of the groove-like recess portions 33 . . . with regard to a sealing region for sealing the groove-like recess portion 33. Specifically, a width of the diaphragm portion 44 is set to be substantially equal to a groove width of the groove-like recess portion 33 and a length of the diaphragm portion 44 is set to be more or less shorter than the length of the groove-like recess portion 33. With regard to the length, according to the embodiment, the length is set to about ⅔ of the length of the groove-like recess portion 33. Further, with regard to a forming position, as shown by FIG. 2, one end of the diaphragm portion 44 is aligned with one end (end portion on a side of the communication port 34) of the groove-like recess portion 33.

As shown by FIG. 7(*b*), the diaphragm portion 44 is fabricated by removing a portion of the support plate 42 in correspondence with the groove-like recess portion 33 in a ring-like shape by etching or the like to leave only the elastic film 43 and an island portion 47 is formed in the ring. The island portion 47 is a portion bonded with a front end face of the piezoelectric oscillator 10.

An ink supply port 45 is a hole for communicating the pressure generating chamber 29 and a common ink chamber 14 and is penetrated in a plate thickness direction of the elastic plate 32. Also the ink supply ports 45 are formed at the respective groove-like recess portions 33 . . . at positions in correspondence with the groove-like recess portions 33 similar to the diaphragm portion 44. As shown by FIG. 2, the ink supply port 45 is bored at a position in correspondence with other end of the groove-like recess portion 33 on a side opposed to the communication port 34. Further, a diameter of the ink supply port 45 is set to be sufficiently smaller than the groove width of the groove-like recess portion 33. According to the embodiment, the ink supply port 45 is constituted by a small through hole of 23 micrometers.

The reason of constituting the ink supply port 45 by the small through hole is for providing a flow path resistance in the pressure generating chamber 29 and the common ink chamber 14. That is, according to the recording head 1, ink drops are ejected by utilizing a variation in a pressure applied to ink at insides of the pressure generating chamber 29. Therefore, in order to efficiently eject ink drops, it is important to prevent the ink pressure in the pressure generating chamber 29 from being escaped to the side of the common ink chamber 14 as less as possible. From the view point, according to the embodiment, the ink supply port 45 is constituted by the small through hole.

Further, when the ink supply port 45 is constituted by the through hole as in the embodiment, there is an advantage that working is facilitated and the high dimensional accuracy is achieved. That is, since the ink supply port 45 is the through hole, the ink supply port 45 can be fabricated by laser machining. Therefore, even the small diameter can be fabricated with high dimensional accuracy and also the operation is facilitated.

Further, the support plate 42 and the elastic film 43 constituting the elastic plate 32 is not limited to those of the example. For example, polyimide may be used as the elastic film 43.

Next, the nozzle plate 31 will be explained. The nozzle plate 31 is a plate-like member made of a metal aligned with nozzle openings 48. According to the embodiment, a stainless steel plate is used therefor and a plurality of the nozzle openings 48 . . . are opened by a pitch in correspondence with a dot forming density. According to the embodiment, the nozzle row is constituted by aligning a total of 180 pieces of the nozzle openings 48 . . . and two rows of the nozzle rows are formed to align transversely. Further, when the nozzle plate 31 is bonded to other surface of the pressure generating chamber forming plate 30, that is, the surface on the side opposed to the elastic plate 32, the respective nozzle openings 48 . . . face the corresponding communication ports 34.

Further, when the elastic plate 32 is bonded to one surface of the pressure generating chamber forming plate 30, that is, a face thereof for forming the groove-like recess portion 33, the pressure generating chamber 29 is partitioned to form by sealing the opening face of the groove-like recess portion 33 by the diaphragm portion 44. Similarly, also the opening face of the dummy recess portion 36 is sealed to partition to form the dummy pressure generating chamber. Further, when the nozzle plate 31 is bonded to other surface of the pressure generating chamber forming plate 30, the nozzle opening 48 faces the corresponding communication port 34. When the piezoelectric oscillator 10 bonded to the island 47 is elongated and contracted under the state, the elastic film 43 at a periphery of the island portion 47 is deformed, the island portion 47 is pushed to the side of the groove-like recess portion 33 or pulled in a direction of being remote from the side of the groove-like recess portion 33. By deforming the elastic film 43, the pressure generating chamber 29 is expanded or contracted to provide a variation in the pressure to ink at inside of the pressure generating chamber 29.

The recording head 1 having the above-described constitution includes a common ink flow path from the ink supply needle 19 to the common ink chamber 14 and an individual ink flow path reaching each of the nozzle openings 48 . . . by passing the pressure generating chamber 29 from the common ink chamber 14. Further, ink stored in the ink cartridge is introduced from the ink supply needle 19 and is stored to the ink storing chamber 14 by passing the common ink flow path. Ink stored in the common ink chamber 14 is ejected from the nozzle opening 48 by passing the individual ink flow path.

For example, when the piezoelectric oscillator 10 is contracted, the diaphragm portion 44 is pulled to the side of the oscillator unit 3 to expand the pressure generating chamber 29. Inside of the pressure generating chamber 29 is brought under a negative pressure by the expansion and therefore, ink in the common ink chamber 14 is made to flow into each pressure generating chamber 29 by passing the ink supply port 45. Thereafter, when the piezoelectric oscillator 10 is expanded, the diaphragm portion 44 is pushed to the side of pressure generating chamber forming plate 30 to contract the pressure generating chamber 29. By the contraction, the ink pressure in the pressure generating chamber 29 rises and ink drops are ejected from the corresponding nozzle opening 48.

Further, according to the recording head, the bottom face of the pressure generating chamber 29 (groove-like recess portion 33) is recessed in the V-like shape. Further, according to the partition wall portion 28 for partitioning the contiguous pressure generating chambers 29, 29, the wall thickness of the root portion is formed to be thicker than the wall thickness of the front end portion. Thereby, the rigidity of partition wall portion 28 can be increased more than that in the background art. Therefore, even when a variation is produced in the ink pressure at inside of the pressure generating chamber 29 in ejecting ink drops, the pressure variation can be made to be difficult to be transmitted to the contiguous pressure generating chamber 29. As a result, so-to-speak contiguous cross talk can be prevented and ejection of ink drops can be stabilized.

Further, according to the embodiment, the dummy pressure generating chambers (that is, hollow portion partitioned by the dummy recess portion 36 and the elastic plate 32) which is not related to ejection of ink drops are provided contiguously to the pressure generating chambers 29, 29 at the end portions of the row and therefore, with regard to the pressure generating chambers 29, 29 at the both ends, one side thereof is formed with the contiguous pressure generating chamber 29 and opposed side thereof is formed with the dummy pressure generating chamber. Thereby, with regard to the pressure generating chambers 29, 29 at the end portions of the row, the rigidity of the partition wall partitioning the pressure generating chamber 29 can be made to equal to the rigidity of the partition wall in other of the pressure generating chambers 29 . . . at a middle of the row. As a result, ink drop ejecting characteristics of all of the pressure generating chambers 29 of one row can be made to be equal.

Further, with regard to the dummy pressure generating chamber, the width of the side of the aligning direction is made to be wider than the width of each of the pressure generating chambers 29 . . . In other words, the width of the dummy recess portion 36 is made to be wider than the width of the groove-like recess portion 33. Thereby, ejecting characteristics of the pressure generating chamber 29 at the end portion of the row and the pressure generating chamber 29 at the middle of the row can be made to be equal with a higher accuracy.

Figure 8:
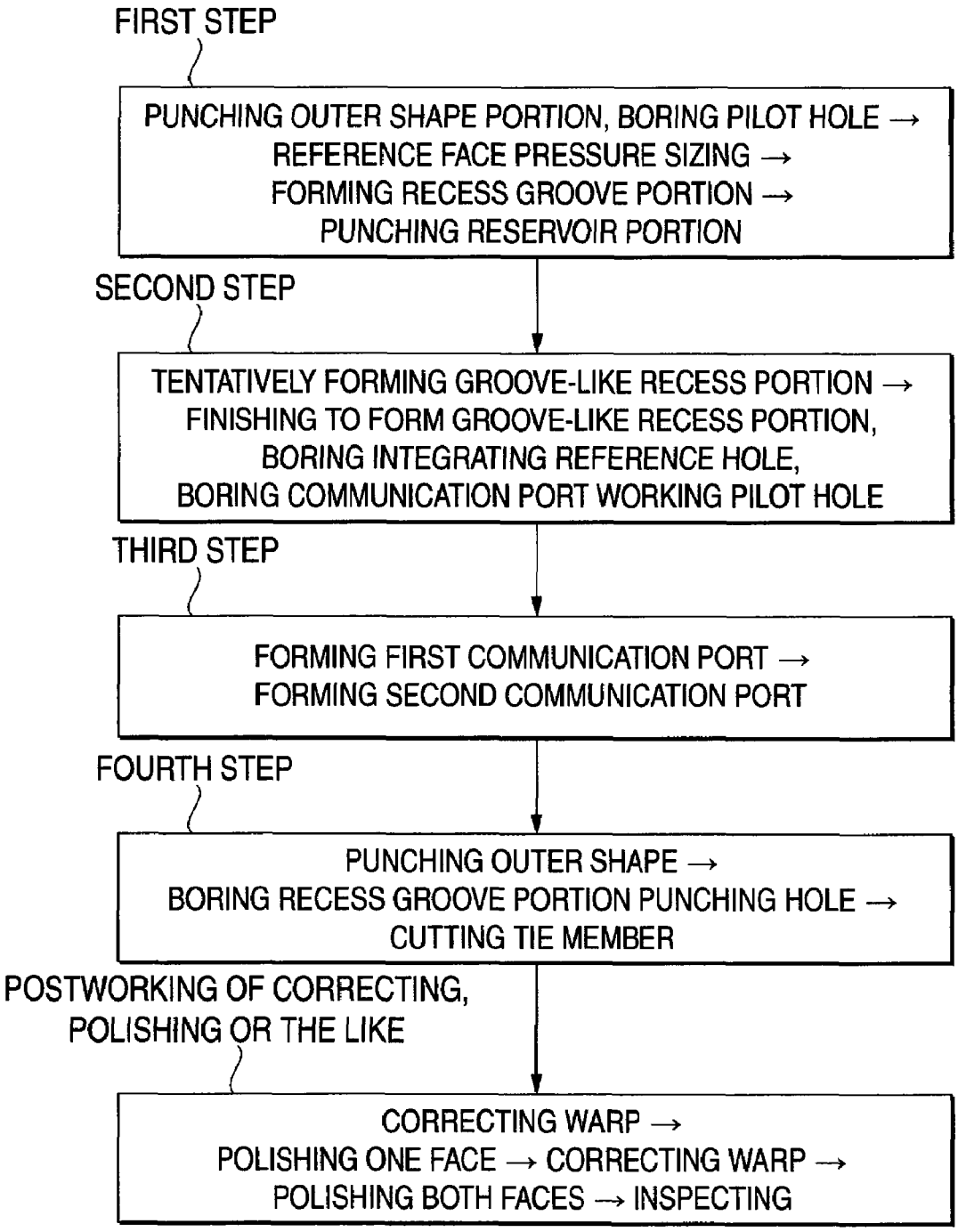
FIG. 8 is a step diagram showing an order of working.

FIG. 8 is a step diaphragm showing an outline of a total of steps of fabricating the pressure generating chamber forming plate 30 and an outline of the steps will be explained based thereon.

A strip made of nickel constituting a metal material is supplied to a successively feeding type forging apparatus having a number of various dies. "First step" of the forging apparatus is constituted by punching an outer shape portion partitioning an outer shape of a product portion, boring a pilot hole, pressure sizing of a reference face for supporting the pressure generating chamber forming plate 30, forming a recess groove portion for absorbing flow of a material, punching the reservoir portion for storing ink and so on.

"Second step" is constituted by tentatively forming the groove-like recess portion for forming the pressure generating chamber, forming to finish the groove-like recess portion, forming a pilot hole required in forming the communication port for introducing ink to the nozzle opening, forming a reference hole for integration in bonding the nozzle plate and the seal plate to the pressure generating chamber forming plate and so on.

"Third step" is a step of forming the communication port at an end portion of the formed groove-like recess portion and is constituted by forming the first communication port for boring a bottomed hole, forming the second communication port for forming the through hole from the bottom portion of the bottomed hole and so on.

"Fourth step" is constituted by punching an outer shape constituting a prestage of forming a single product of the pressure generating chamber forming plate, boring a punch hole of the recess groove portion, forming a single product of the pressure generating chamber forming plate by cutting a tie member and so on.

"Postworking of correcting, polishing or the like" is constituted by correcting warp of the pressure generating chamber formed in a single product, polishing one face of the pressure generating chamber forming plate, correcting warp again, polishing both faces thereof, inspecting and so on.

Next, a method of fabricating the recording head 1 will be explained. Further, the fabricating method is characterized in a step of fabricating the pressure generating chamber forming plate 30 and therefore, an explanation will be given centering on the step of fabricating the pressure generating chamber forming plate 30. Further, as has been explained in reference to FIG. 8, the pressure generating chamber forming plate 30 is fabricated by executing forging by a successive feeding type of the respective steps, that is, pressing. A strip used as the material of the pressure generating chamber forming plate 30 is made of nickel as described above.

FIG. 9 through FIG. 18 respectively show states of changing shapes of working a material 55 from "first step" to "fourth step" mentioned above in an order of working. Further, the respective views show the material 55 as plane views, illustrate dies achieving principal working functions in respective working stages on upper sides of respective working stages and illustrates sectional views of the main working portions thereof on lower sides of respective working stages. The sectional views show sections by section lines described in the respective working stages.

Figure 9:
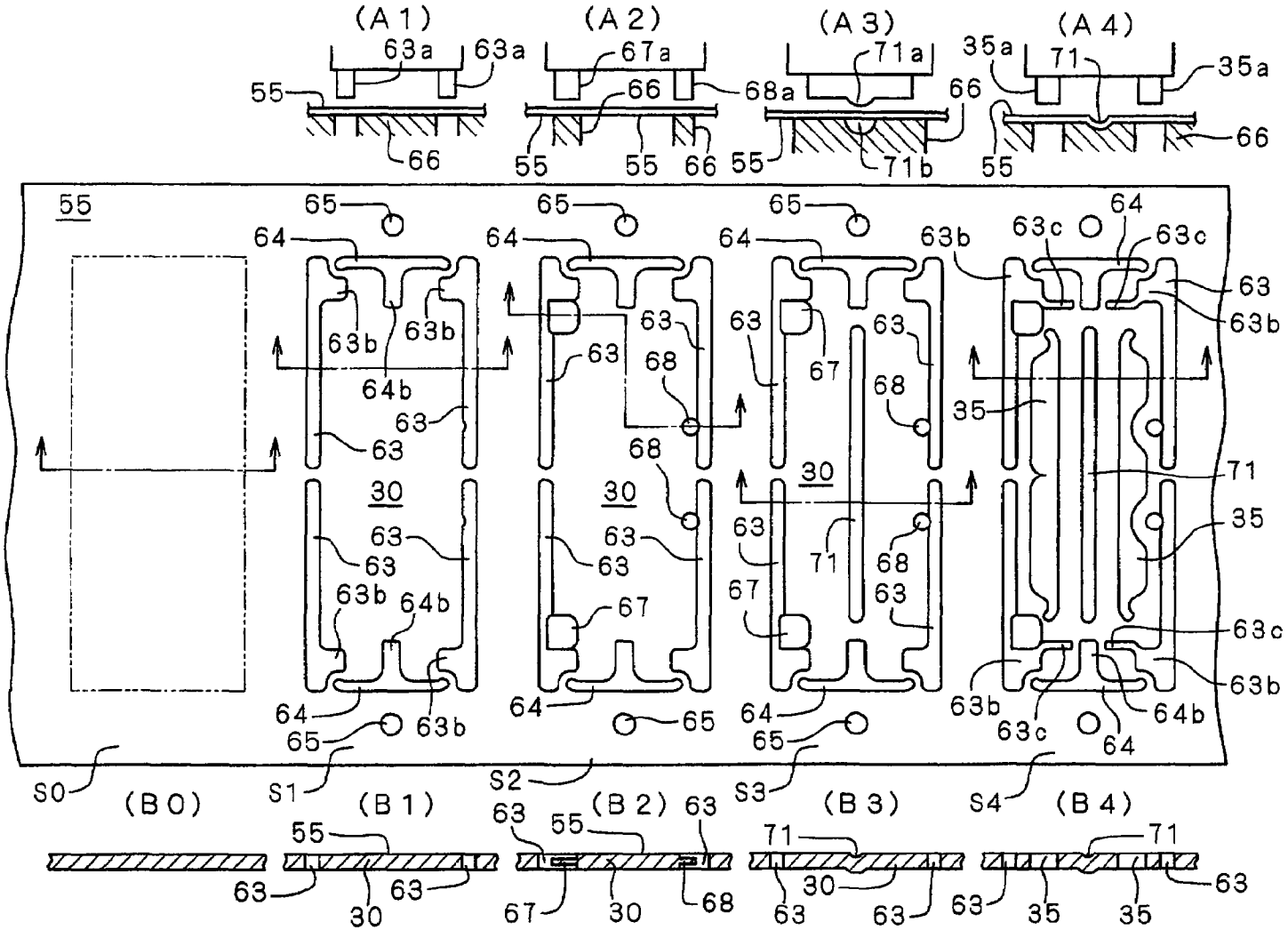
FIG. 9 is a plane view of a strip successively showing working stages in a first step.

At "first step", as shown by FIG. 9, the material 55 brought into an unworked state is in a so-to-speak zero stage indicated by a portion of S0.

A first stage S1 is a step of punching an outer shape portion partitioning an outer shape of the pressure generating chamber forming plate 30 and four slender vertical outer shape portions 63 and the two horizontal outer shape portions 64 in a T-like shape are punched. Simultaneously with punching the outer shape portions 63, 64, a pilot hole 65 for positioning the material 55 in the respective working stages is punched. In FIG. 9(A1), the material 55 is mounted on a lower die 66 and the vertical outer shape portion 63 is punched by a boring punch 63*a*. When the outer shape portions 63, 64 are punched as described above, an inner side thereof constitutes a region of working the pressure generating forming plate 30. Further, an expanded portion 63*b* of the vertical outer shape portion 63 and a vertical slit portion 64*b* of the horizontal outer shape portion 64 are brought into an opposed positional relationship.

Figure 15:
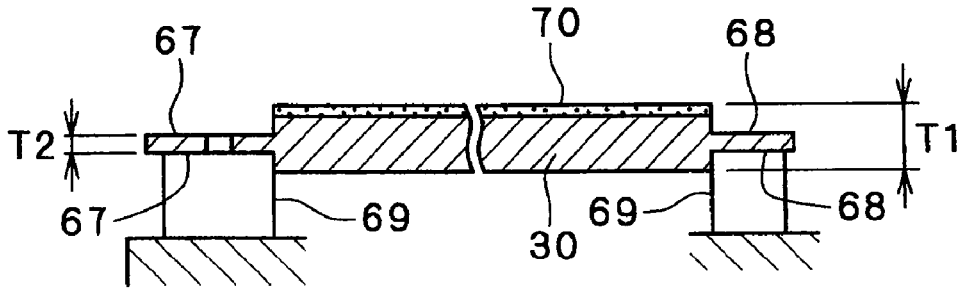
FIG. 15 is a side view showing a state of supporting a reference face of the pressure generating chamber forming plate.

A second stage S2 is a step of pressure sizing of a reference face. The reference faces 67, 68 are support faces for supporting the pressure generating chamber forming plate 30 when an adhering agent is coated on the pressure generating chamber forming plate 30. That is, as shown by FIG. 15, a thickness T2 of portions of the reference faces 67, 68 are thinned by pressing a thickness T1 of a region for constituting the pressure generating chamber forming plate 30. The reference faces 67, 68 of the pressure generating chamber forming plate 30 finally finished as a single product are mounted on a support jig 69 and an adhering agent 70 is coated thereon. At this occasion, since there is a stepped difference (T1−T2/2) between a surface of the pressure generating chamber forming plate 30 and the reference faces 67, 68, the adhering agent 70 is not adhered to the reference faces 67, 68. Further, the stepped difference (T1−T2/2) shown in FIG. 15 is illustrated exaggeratingly to facilitate to understand. Notations 67*a*, 68*a* of FIG. 9(A2) designate punches for pressing for executing pressing operation by being paired with the lower die 66.

A third stage S3 is a step of forming a recess groove portion 71. The recess groove portion 71 is for preventing the material 55 from being raised by making the material flow in a longitudinal direction of the groove-like recess portion 33 when the groove-like recess portion 33 is pressed and flow of the material is absorbed by a space of the recess groove portion 71. In FIG. 9(A3), the punch is provided with a projected streak 71*a* for forming the recess groove portion 71 and a recess groove 71*b* provided at the lower die 66 paired therewith is illustrated.

A fourth stage S4 is a step of punching the reservoir portion 35 along the recess groove portion 71 at a region of the pressure generating chamber forming plate 30, a slender portion is arranged between the reservoir portion 35 and the recess groove portion 71, where the groove-like recess portion 33 is formed. Notation 35*a* of FIG. 9(A4) designates a punch for punching and paired with the lower die 66. Further, an extended slit 63*c* extended from the expanded portion 63*b* to the vertical slit portion 64*b* is punched between the expanded portion 63*b* and the vertical slit portion 64*b*. The expanded slit 63*c* is punched simultaneously with the reservoir portion 35. By punching the expanded slit 63*c* at the stage of S4, it can be prevented that the shape of the punch 63*a* of the vertical outer shape portion 63 becomes complicated and durability of the punch is deteriorated.

Figure 12:
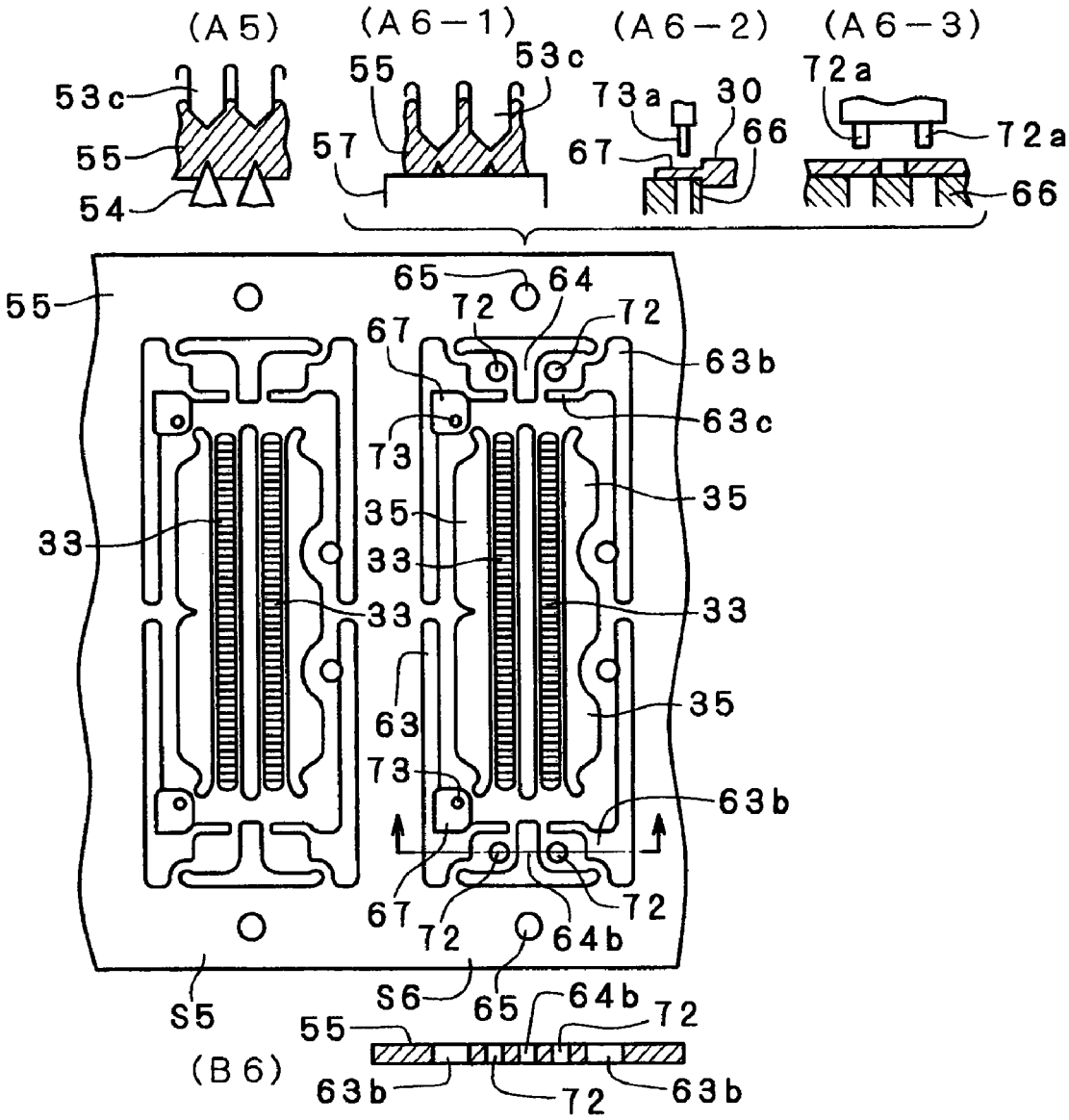
FIG. 12 is a plane view of the strip successively showing working stages in a second step.

As shown by FIG. 12, "second step" executes boring of a pilot hole for working the groove-like recess portion 33, the communication port 34 and boring of a reference hole for integration.

As shown by FIG. 12(A5), a fifth stage S5 is tentative forming of the groove-like recess portion 33, projected streak portions 53, 53*c* and a streak-like projection 54, mentioned later, are pressed to the strip 55, and the grove-like recess portion 33 is formed up to a middle stage thereof.

As shown by FIG. 12(A6-1), a sixth stage S6 is forming to finish the groove-like recess portion 33, and the strip 55 is further pressed between the projected streak portions 53, 53*c* and a finishing die 57, mentioned later. The projected streak portions 53, 53*c* are pressed up to a required deepest portion of the groove-like recess portion 33 and is stopped at a maximum stroke position to finish the groove-like recess portion 33 to a predetermined dimension.

Here, at S6, while the projected streak portions 53, 53*c* stay to be stopped at the maximum stroke position, a reference hole 73 for integration is bored at the reference face 67, and a pilot hole 72 for working the communication port is bored. As shown by FIG. 12(A6-2), a boring punch 73*a* for boring the integrating reference hole 73 is paired with the lower die 66. Further, as shown by FIG. 12(A6-3), four pieces of the communication hole working pilot holes 72 are bonded and a boring punch 72*a* for boring the pilot hole 72 is paired with the lower die 66.

Further, although when the projected streak portions 53, 53*c* pressed to the maximum stroke position are drawn, a space portion of the groove-like recess portion 33 is elastically deformed (so-to-speak spring back) and the displacement constitutes a factor of deviating positions of the integrating reference hole 73 and the pilot hole 72, the reservoir portion 35, the extended slit 63*c*, the expanded portion 63*b* and the horizontal outer shape portion 64 and the like absorb the elastic deformation and the holes 73, 72, the pilot hole 65 and the like are prevented from being deviated. Further, since the integrating reference hole 73 and the communication port working pilot hole 72 are worked to bore while the projected streak portion 53*c* stays to be stopped at the maximum stroke position, positional accuracies of the integrating reference hole 73 and the communication port working pilot hole 72 relative to the groove-like recess portion 33 can be ensured.

Figure 16:
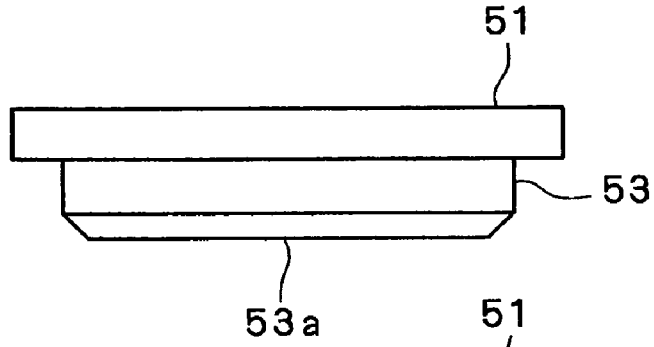
FIGS. 16(*a*) and (*b*) are views for explaining a male die used in forming a groove-like recess portion.
Figure 16:
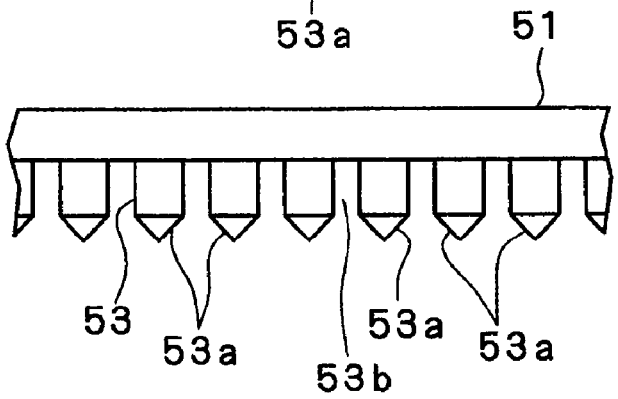
Figure 17:
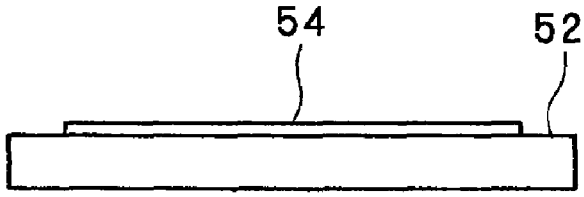
FIGS. 17(*a*) and (*b*) are views for explaining a female die for forming the groove-like recess portion.
Figure 17:
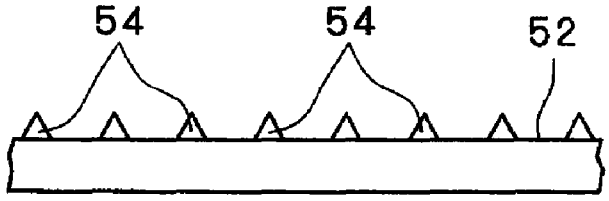

Here, in the groove-like recess portion forming step, a male die 51 shown in FIG. 16 and a female die 52 shown in FIG. 17 are used. The male die 51 is a die for forming the groove-like recess portion 33. The male die 51 is aligned with projected streak portions 53 for forming the groove-like recess portions 33 by a number the same as that of the groove-like recess portions 33. Further, there are also provided dummy projected streak portions (not illustrated) for forming the dummy recess portion 36 contiguously to the projected streak portions 53 at both end portions in the aligning direction. A front end portion 53*a* of the projected streak portion 53 is constituted by a converging hat shape, and as shown by, for example, FIG. 16(*b*), faced by an angle of about 45 degrees from a center in a width direction. That is, the front end portion 53*a* in a wedge-like shape is formed by an inclined face of the hat shape formed at a front end of the projected streak portion 53. Thereby, the front end portion 53*a* is sharpened in a V-like shape by viewing from a longitudinal direction. Further, as shown by FIG. 16(*a*), both ends in the longitudinal direction of the front end portion 53*a* are faced by an angle of about 45 degrees. Therefore, the front end portion 53*a* of the projected streak portion 53 is constituted by a shape of facing both ends of a triangular prism.

Further, the female die 52 is formed with a plurality of the streak-like projections 54 at an upper face thereof. The streak-like projection 54 is for assisting to form a partition wall for partitioning the contiguous pressure generating chambers 29, 29 and is arranged at a position opposed to the front end portion 53*a* of the projected streak portion 53. The streak-like projection 54 is constituted by a wedge shape and a length thereof is set to be about the same as a length of the groove-like recess portion 33 (projected streak portion 53).

Figure 18:
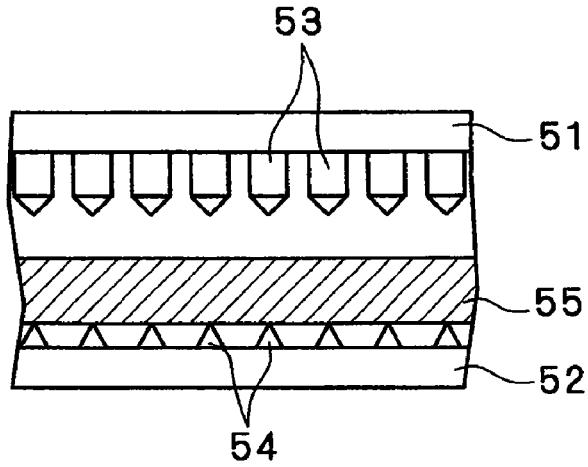
FIGS. 18 (*a*) through (*c*) are schematic views for explaining formation of the groove-like recess portion.
Figure 18:
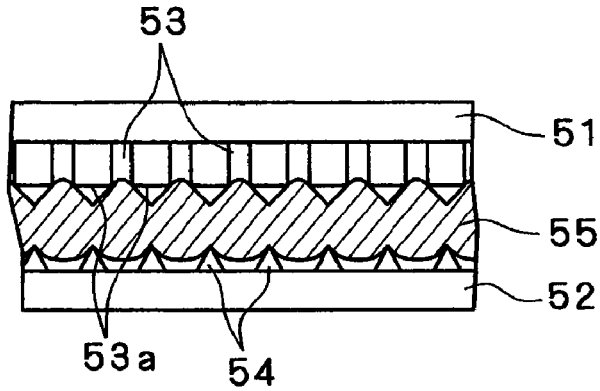
Figure 18:
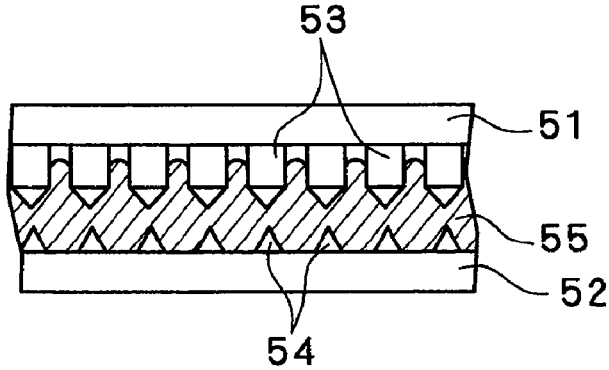

Further, in the groove-like recess portion forming step, first, as shown by FIG. 18(*a*), the strip 55 constituting the material and the pressure generating chamber forming plate is mounted on an upper face of the female die 52, and the male die 51 is arranged above the strip 55. Next, as shown by FIG. 18(*b*), the front end portion of the projected streak portion 53 is pressed into the strip 55 by moving down the male die 51. At this occasion, since the front end portion 53*a* of the projected streak portion 53 is sharpened in the V-like shape, the front end portion 53*a* can firmly be pressed into the strip 55 without buckling the projected streak portion 53. As shown by FIG. 18(*c*), the projected streak portion 53 is pressed up to a middle in a plate thickness direction of the strip 55.

By pressing the projected streak portion 53, a portion of the strip 55 flows and the groove-like recess portion 33 is formed. Here, since the front end portion 53*a* of the projected streak portion 53 is sharpened in the V-like shape, even the groove-like recess portion 33 having a small shape can be formed with a high dimensional accuracy. That is, a portion pressed by the front end portion 53*a* smoothly flows and therefore, the formed groove-like recess portion 33 is formed by a shape following a shape of the projected streak portion 53. At this occasion, the material flowing to be pressed to divide by the front end portion 53*a* flows into a gap portion 53*b* provided between the projected streak portions 53 and the partition wall portion 28 is formed. Further, since also the both ends in the longitudinal direction of the front end portion 53*a* are faced, also the strip 55 pressed at the portion smoothly flows. Therefore, also the both end portions in the longitudinal direction of the groove-like recess portion 33 can be fabricated with a high dimensional accuracy.

Further, since pressing of the projected streak portion 53 is stopped at the middle in the plate thickness direction, the strip 55 thicker than that in the case of forming a through hole can be used. Thereby, the rigidity of the pressure generating chamber forming plate 30 can be promoted, and a characteristic of ejecting ink drops can be promoted. Further, the pressure generating chamber forming plate 30 is facilitated to handle.

Further, by pressing by the projected streak portion 53, a portion of the strip 55 is raised into a space between the contiguous projected portions 53, 53. Here, as described above, the streak-like projection 54 provided at the female die 52 is arranged at a position opposed to each projected streak portion 53 and therefore, the metal material strongly pinched between the projected streak portion 53 and the streak-like projection 54 flows to the left or to the right of the projected streak portion 53 to be brought into the space between the projected streak portions 53. Thereby, the strip 55 can efficiently be introduced into the space between the projected streak portions 53 and a portion having a shallow bottom, that is, the partition wall portion 28 can be formed to be high.

Figure 13:
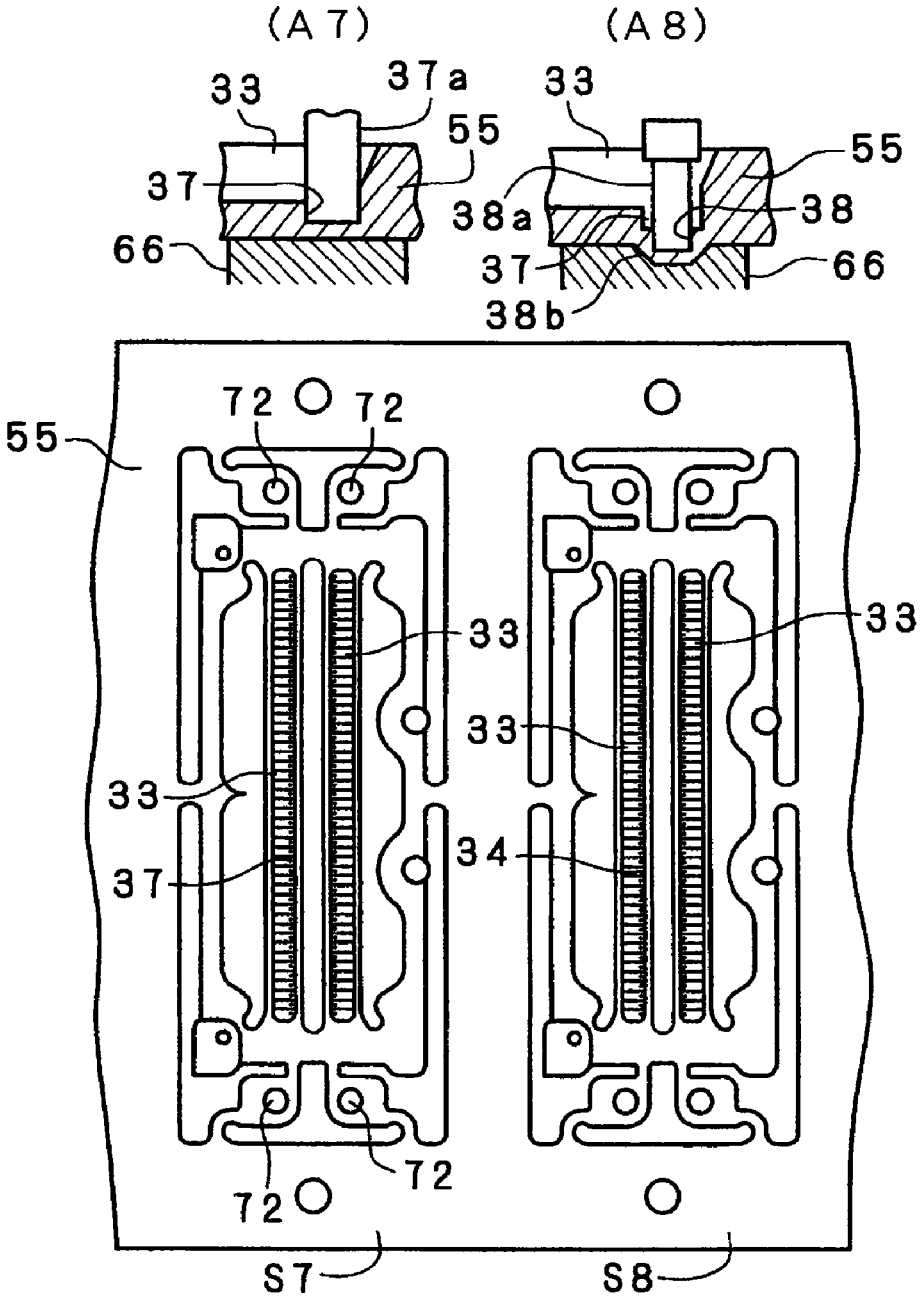
FIG. 13 is a plane view of the strip successively showing working stages in a third step.

As shown by FIG. 13, "third step" is a step of boring the communication port 34 by forming the first communication port 37 and forming the second communication port 38.

A seventh stage S7 is a step of pressing to form the bottomed first communication port 37 at the end portion of the groove-like recess portion 33, and as shown by FIG. 13(A7), a boring punch 37*a* is paired with the lower die 66. According to the step of boring the communication port 34, a reference pin (not illustrated) provided at the lower die 66 penetrates the pilot hole 72 as in an eighth stage S8, described below, and a positional shift of the strip 55 is prevented from being brought about. Thereby, the accurate communication port 34 is formed at the end portion of the small groove-like recess portion 33.

An eighth stage S8 is a step of boring the bottomed second communication port 38 at a bottom portion of the first communication port 37 and by making the metal material flow at this occasion, a bulged portion 38*b* is formed on a rear face side of the strip 55. By polishing the bulged portion 38*b* in "postworking of correcting, polishing or the like", mentioned later, the penetrated communication port 34 is finished. As shown by FIG. 13(A8), a boring punch 38*a* is paired with the lower die 66 and the bulged portion 38*b* is formed.

Although S7 and S8 may be constituted by working by successive feeding as described above, when the boring punches 37*a*, 38*a* are small and a frequency of damaging the punches is high, S7 and S8 can also be constituted by working by individual feeding.

Figure 14:
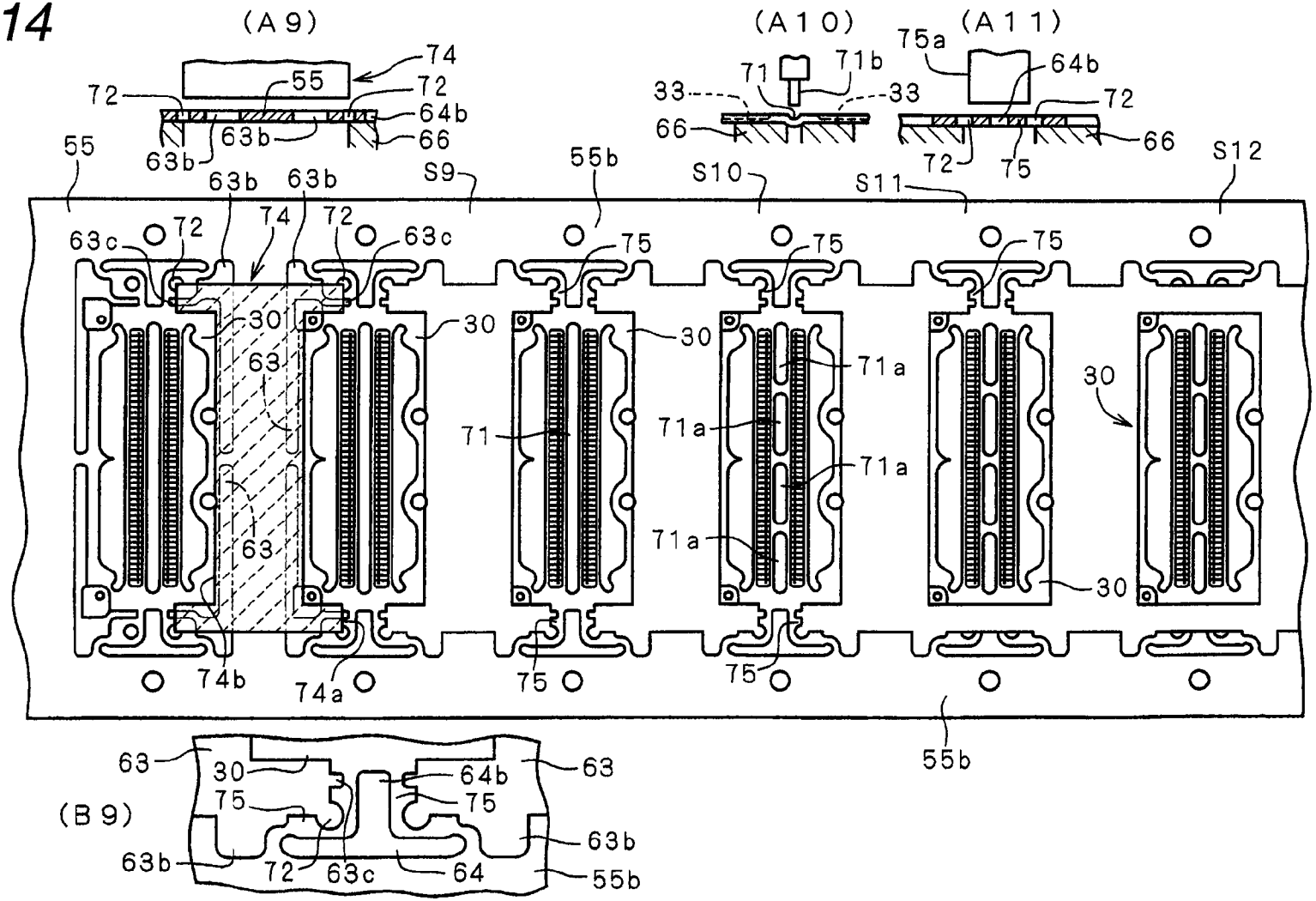
FIG. 14 is a plane view of the strip successively showing working stages in a fourth step.

As shown by FIG. 14, "fourth step" is constituted by punching of the vertical outer shape portion 63, punching to bore the recess groove portion 71 and cutting the tie member.

As shown by FIG. 14, a ninth stage S9 is a step of a preparatory stage of forming a single product of the pressure generating chamber forming plate 30 by punching the vertical outer shape portion 63, and as shown by FIG. 14(A9), a punching die 74 is punched between the contiguous pressure generating chamber forming plates 30. Although an actual punching operation is executed at a portion designated by notation S9, here, in order to understand a positional relationship between the punching die 74 and the vertical outer shape portion 63, the hatched punching die 74 is illustrated on the left side of S9 for reference. The punching die 74 is constituted by a wide width portion 74*a* having a span reaching the pilot holes 72 of the contiguous pressure generating chamber forming plates 30 and a narrow width portion 74*b* having a span reaching the contiguous vertical outer shape portion 63. When successively punched by the punching die 74 at S9, the tie member 75 for connecting a portion of the pressure generating chamber forming plate 30 and portions 55*b* on both left and right sides in an advancing direction of the strip 55 are formed. FIG. 14(B9) is an enlarged plane view showing a portion of the portion punched by the punching die 74.

A tenth stage S10 is a step of forming four slit holes 71*a* by punching four portions of the recessed groove portion 71. As shown by FIG. 14(A10), a boring punch 71*b* for punching the slit hole 71*a* is paired with the lower die 66. By providing the slit hole 71*a*, polishing time period can be shortened by narrowing a region of a portion bulged to the rear face side of the recess groove portion 71. Further, an adhering area can be prevented from being widened uselessly and therefore, an extra amount of an adhering agent 70 is reduced and the adhering agent 70 can be prevented from being brought into the groove-like recess portion 33. Further, by communicating the slit hole 71*a* at the end portion in the formed silt holes 71*a* to outside, a total of the slit hole 71*a* is brought into a state of being communicated with outside air and a phenomenon of breathing air by drying the adhering agent or a temperature change or the like can be executed.

An eleventh stage S11 is a step of punching one of the tie members 75 disposed at two portions. As shown by FIG. 14(A11), a punching die 74*a* and the lower die 66 are paired and when the tie portion 75 is punched, a continuous state of the portions 55*b* on the both left and right sides of the strip 55 and the portion of the pressure generating chamber forming plate 30 is cut as shown by a lower side of S11.

A twelfth stage S12 is a step of punching other of the member 75 similar to the eleventh stage S11. By punching the tie member 75, the pressure generating chamber forming plate 30 is cut to separate from the strip 55 and is brought into a single product state.

"Correcting, polishing or the like" is carried out after the "fourth step".

Figure 19:
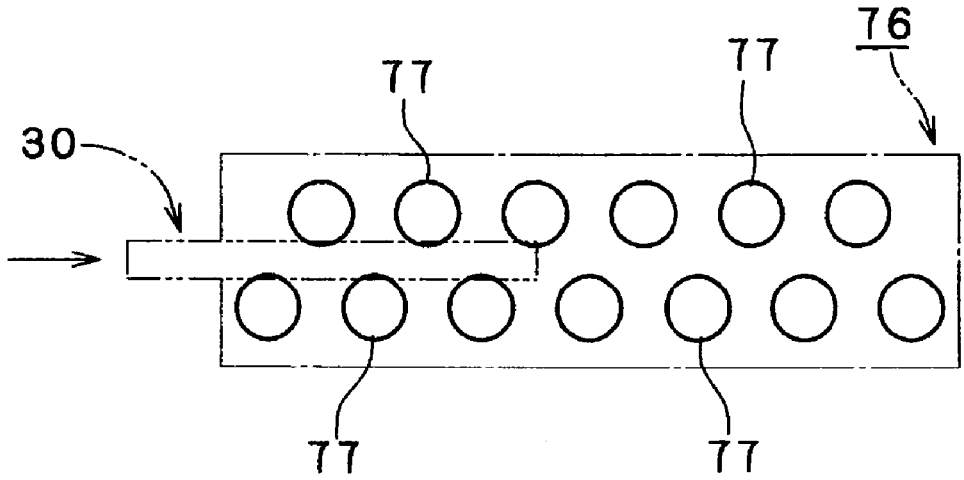
FIG. 19 is a side view simplifiedly showing a roller type correcting apparatus.

The pressure generating chamber forming plate 30 in the single product state immediately after having been cut to separate from the strip 55 is not brought into a completely flat state but is warped or bent slightly since various residual stresses are present. In order to correct such a state, "correction of warp" is carried out. Although various methods of correcting the warp can be adopted, in this example, as shown by FIG. 19, a roller type correcting apparatus 76 is adopted. There are arranged one set of a number of correction rollers 77 aligned on one imaginary plane at predetermined intervals therebetween and the pressure generating chamber forming plate 30 is passed therebetween to correct. At this occasion, when the pressure generating chamber forming plate 30 is initially passed in the longitudinal direction, thereafter, the direction is changed by 90 degrees and correction is carried out again. That is, by feeding the pressure generating chamber forming plate 30 to the correction rollers 77 in X, Y directions, further accurate correction is carried out.

Figure 20:
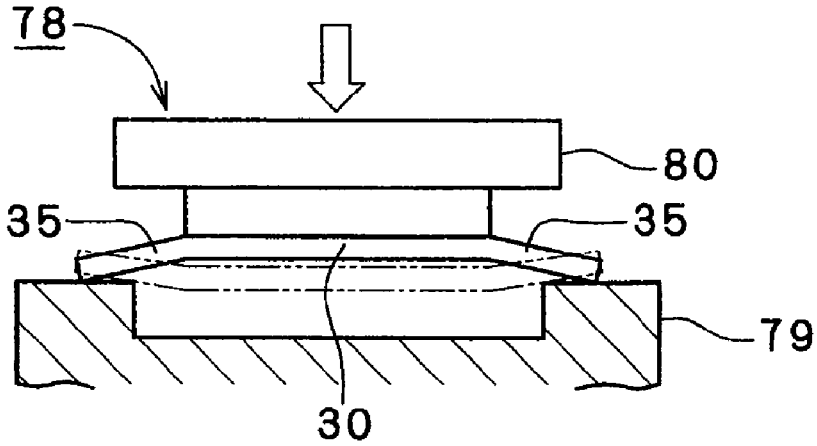
FIG. 20 is a side view of a hand press type correcting apparatus.

A hand press type correction apparatus 78 shown in FIG. 20 can also be used in place of the roller type correction apparatus 76. As shown by FIG. 20, the reservoir portions 35 arranged on both left and right sides of the pressure generating chamber forming plate 30 are brought into a deformed state bent by stresses of forming the groove-like recess portions 33 or the like and therefore, the bent portion is corrected by pressing the pressure generating chamber forming plate 30 mounted on a lower die 79 by an upper die 80.

Figure 21:
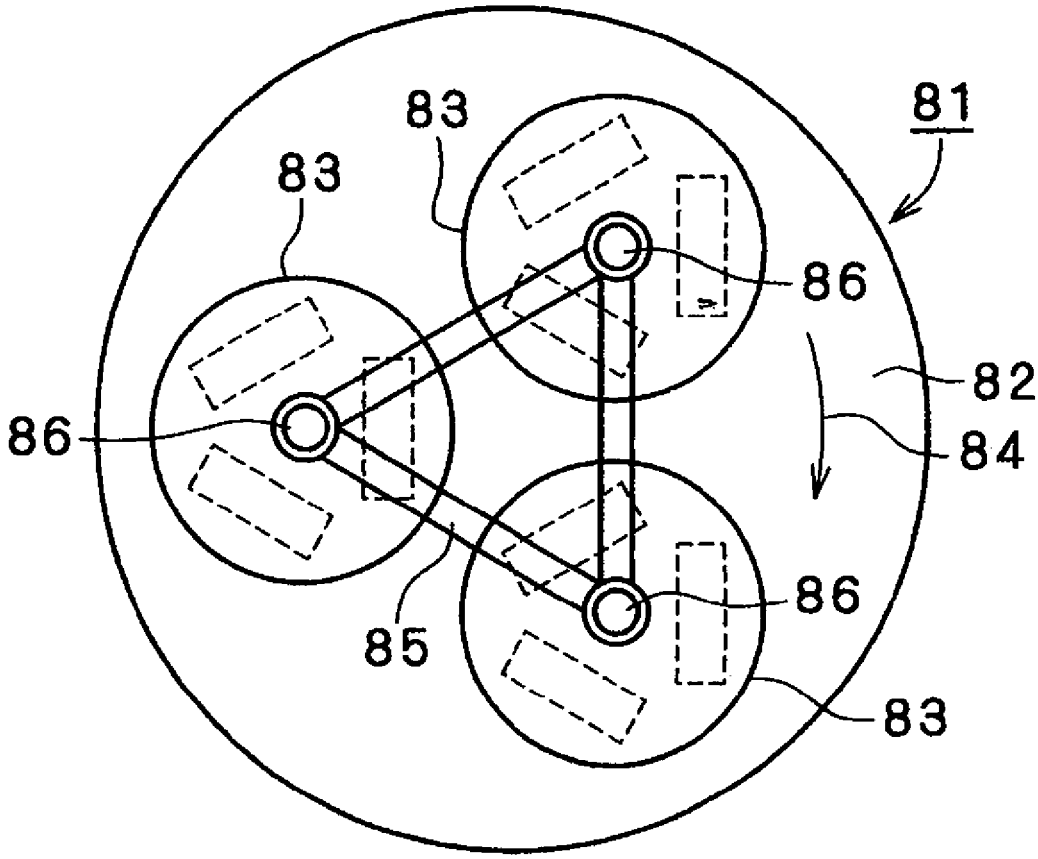
FIG. 21 is a plane view of a one face polishing apparatus.

When the warp has been finished to correct, one face of the pressure generating chamber forming plate 30 is polished by a polishing apparatus shown in FIG. 21. Although various types of polishing apparatus can also be adopted, here, a rotating type polishing apparatus 81 is adopted. That is, a rotating type holding disk 83 is provided to be paired with a polishing level block 82 constituted by a flat face, the pressure generating chamber forming plate 30 is held by the holding disk 83 and the holding disk 83 is revolved (refer to arrow mark line 84) while being rotated. In this way, the pressure generating plate forming plate 30 is polished by the polishing level block 82. Further, numeral 85 designates a link mechanism for correcting the holding disks 83 to revolve and each holding disk 83 is rotated by exerting a rotational force to a shaft 86 thereof.

Figure 22:
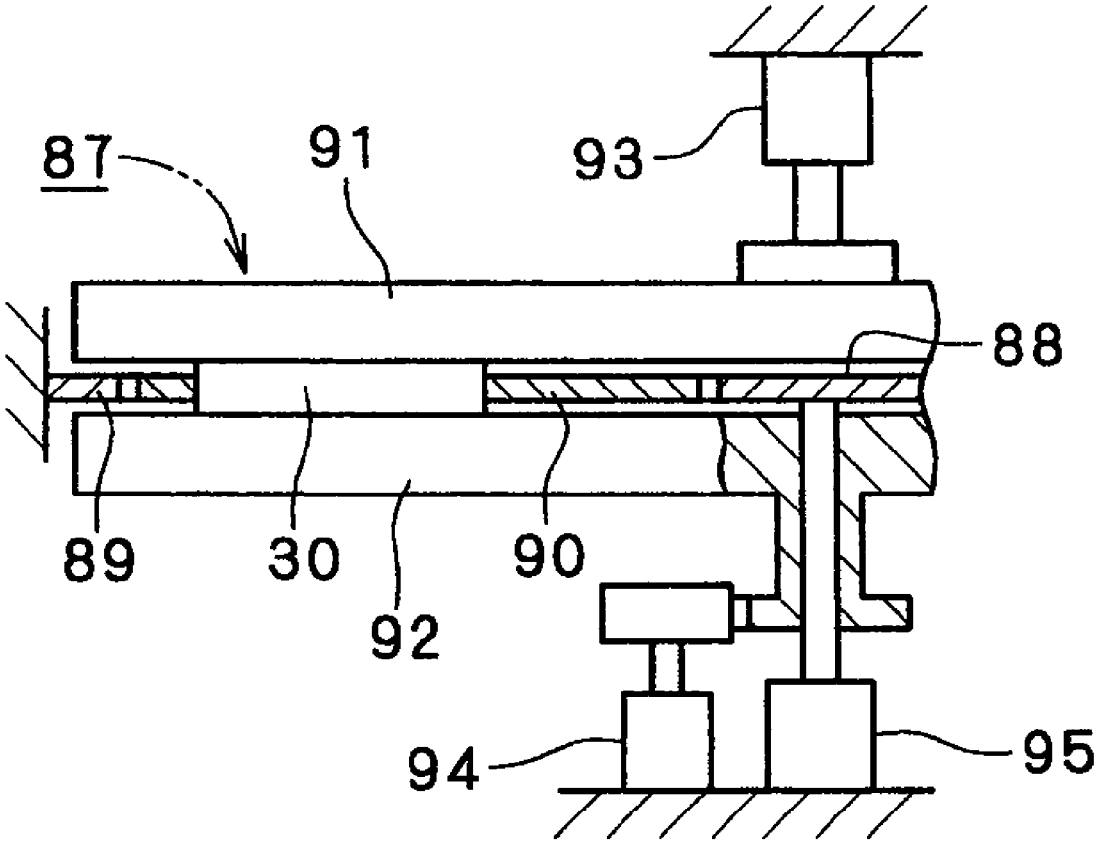
FIG. 22 is a side view of a both faces polishing apparatus.

Since in the one face polishing, a thickness of the pressure generating chamber forming plate 30 is changed and therefore, warp or bending is produced in accordance therewith. Therefore, correction of warp is carried out again by a method similar to that shown in FIG. 19 or FIG. 20. When the correction has been finished, both faces polishing is carried out. FIG. 22 is a sectional view showing a both faces polishing apparatus 87. Between a sun gear portion 88 at a center portion and an internal gear 89 at an outer peripheral portion, a planetary gear disk 90 is brought in mesh with the two gears 88, 89. The pressure generating chamber forming plate 30 is fitted to be held by the planetary gear disk 90, and polishing level blocks 91, 92 for polishing both faces of the pressure generating chamber forming plate 30 are arranged in a state of being opposed to each other. The polishing level blocks 91, 92 are driven to rotate by electric motors 93, 94, further, the sun gear 88 is driven to rotate by an electric motor 95.

When the both faces polishing has been finished, the operation proceeds to an inspecting step to carry out a final check.

Next, an explanation will be given of a working method for correctly working end portions of the groove-like recess portions 33 along an imaginary line having a predetermined shape.

Figure 11:
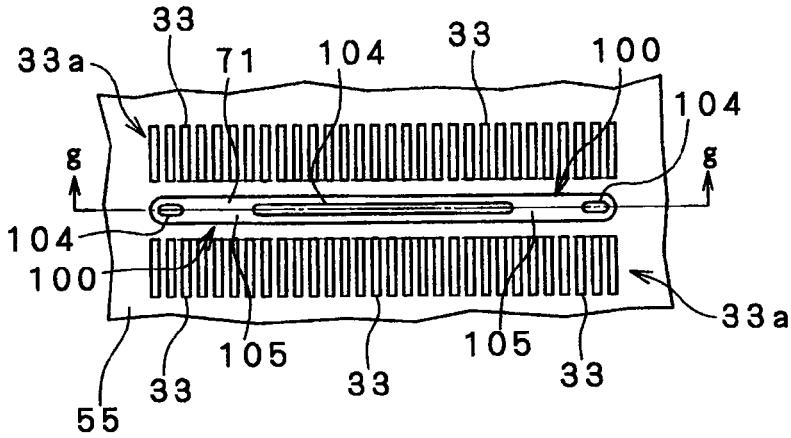
FIG. 11 illustrates plane views and a sectional view showing a state of forming the highly rigid portion.
Figure 11:
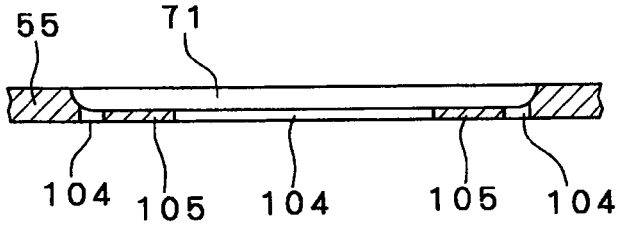
Figure 11:
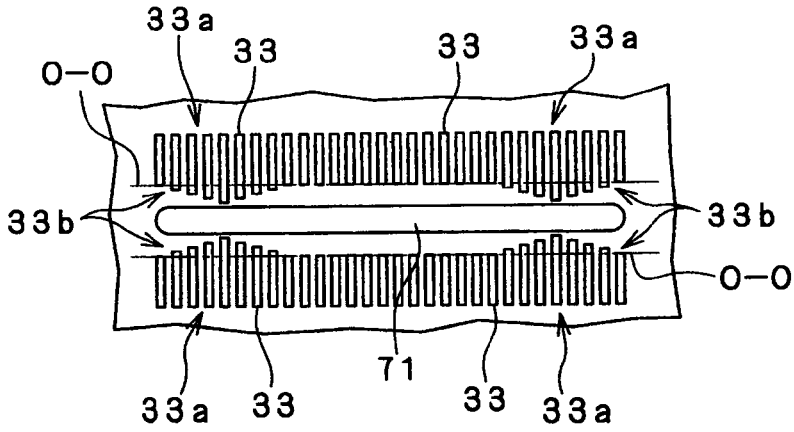

In a series of pressing, as shown by FIG. 11(*h*), it has been found that there is brought about a phenomenon in which the end portions of the groove-like recess portions 33 are not aligned on an imaginary line O-O having a predetermined shape. The imaginary line O-O having the predetermined shape in this case is in parallel with the recess groove portion 71 arranged linearly and is constituted by a linear line. In the case shown in FIG. 11(*h*), the end portions on the side of the recess groove portion 71 of the groove-like recess portions 33 are partially projected to the side of the recess groove portion 71 and is not aligned on the imaginary line O-O, and such an abnormal aligning is brought about significantly at a vicinity of an end portion of the row 33*a* of the groove-like recess portions 33, that is, at a vicinity of an end portion of the imaginary line O-O.

The above-described groove-like recess portions 33 are formed by pressing the projected portions 33, 33*c* constituting male dies aligned by a predetermined number of pieces to the pressure generating chamber forming plate 30. The end portions of the groove-like recess portions 33 in the aligned state formed in this way are aligned on the imaginary line O-O having the predetermined shape. Therefore, the both ends of the imaginary line O-O are made to be substantially the same as a starting end of aligning and a final end of aligning the projected portions 53, 53*c* and therefore, lengths thereof are made to be substantially the same as lengths of aligning the projected portions 53, 53*c*.

It seems that the above-described abnormal aligning is brought about by forming a number of the aligned groove-like recess portions 33 as small recess portions, a width of the groove is very narrow, further a wall thickness of the partition wall portion 28 for partitioning the groove-like recess portions 33 is extremely thin and therefore, a variation in the shape of the groove-like recess portion 33 is brought about by a phenomenon of making a metal material (strip 55) flow in working or other working conditions. Notation 33*b* designates an abnormal aligning portion. It seems that the groove-like recess portions 33 of portions of specific portions are extended to the side of the recess groove portion 71 in this way because when the groove-like recess portions 33 are formed at the fifth and the sixth stages of the second step, a material of the strip 55 of the portions are liable to flow in the longitudinal direction of the groove-like recess portions 33.

Hence, according to the invention, a basic way of thinking is constituted by restraining a phenomenon that the groove-like recess portion 33 is liable to extend from the imaginary line O-O to the side of the recess groove portion 71. That is, prior to pressing the groove-like recess portion 33 in the row-like shape by pressing the predetermined number of pieces of the aligned male dies (projected portions 53, 53*c*) to the pressure generating chamber forming plate 30, the pressure generating chamber forming plate 30 is previously formed with a highly rigid portion 100 to deal with a region in which a predetermined portion at a vicinity of the imaginary line O-O extended in the row direction along an end portion of a portion predicted to be pressed to which the respective projected portions 53, 53*c* are pressed, particularly, an end portion of the groove-like recess portion 33 on the side of the recess groove portion 71 is partially projected to the side of the recess groove portion 71 and is not aligned on the imaginary line O-O.

As a working step thereof when the recess groove portion 71 is formed, the highly rigid portion 100 is formed simultaneously therewith, thereafter, the step of forming the groove-like portion 33 is executed.

Figure 10:
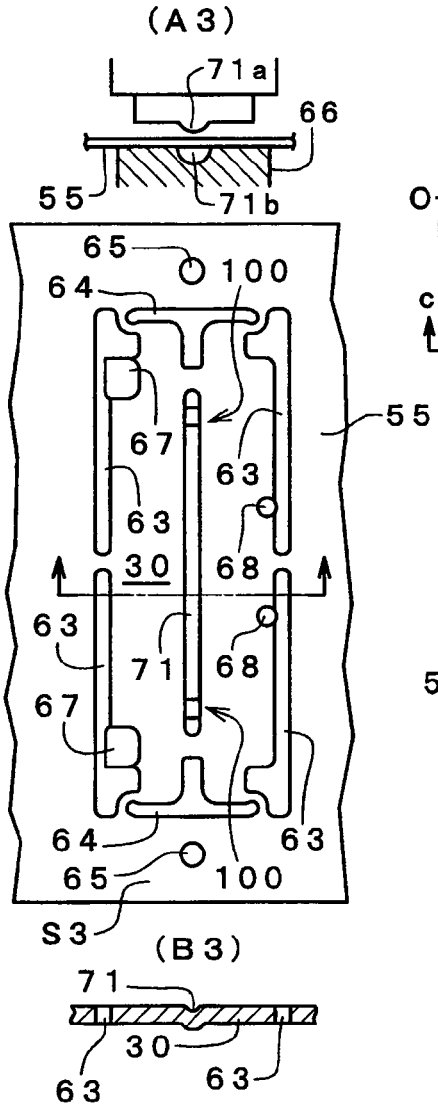
FIG. 10 illustrates plane views and sectional views showing a state of forming a highly rigid portion.
Figure 10:
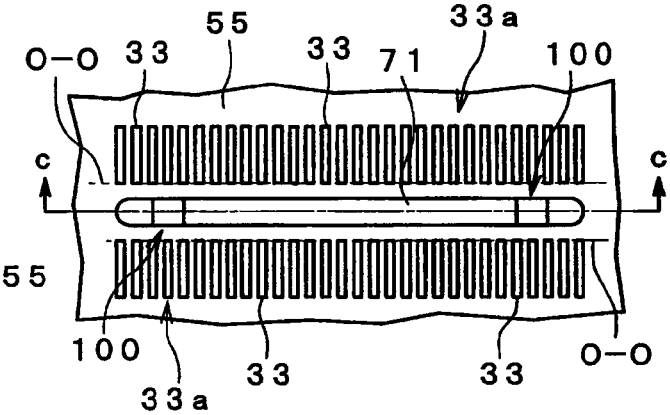
Figure 10:
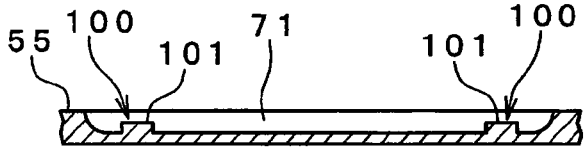
Figure 10:
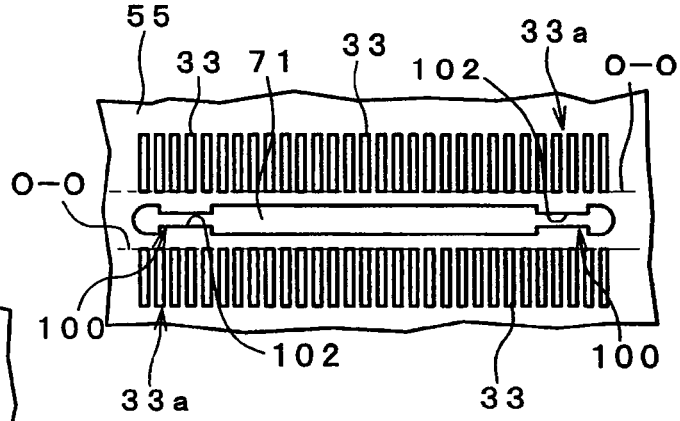
Figure 10:
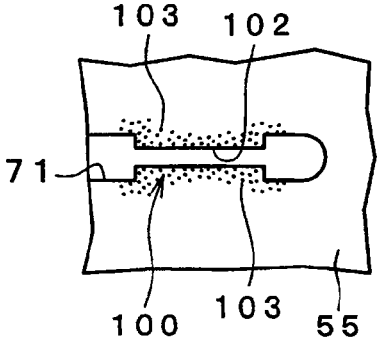

FIG. 10(*a*) excerpts to show the third stage S3 of the first step shown in FIG. 9. At the third stage S3, the recess groove portion 71 is formed. In forming the recess groove portion 71, as shown by FIGS. 10(*a*), (*b*) and (*c*), there is formed the highly rigid portion 100 as a portion having a shallow bottom by partially shallowing the bottom portion of the recess groove portion 71. Notation 101 designates a shallow bottom portion. A height of the shallow bottom portion 101 is set to be lower than a depth of the recess groove portion 71. The highly rigid portion 100 is arranged at a vicinity of the imaginary line O-O in correspondence with the abnormal aligning portion 33*b*. Further, the imaginary line O-O in the FIGS. 10(*a*), (*b*) and (*c*) is a linear line.

By arranging the shallow bottom portion 101 as described above, a wall thickness of the portion is increased and the rigidity in the width direction of the recess groove portion 71 is increased thereby. Therefore, in the step of forming the groove-like recess portion 33 at the fifth and the sixth stages of the second step, even when a phenomenon in which the groove-like recess portion 33 is going to be extended in the width direction of the recess groove portion 71, the extending phenomenon is restrained by the highly rigid portion 100 and the end portion of the groove-like recess portion 33 is normally aligned without being shifted from the imaginary line O-O. That is, even when the material of the strip 55 at an end portion of the groove-like recess portion 33 is going to flow to the side of the recess groove portion 71, the flow is restrained since the shallow bottom portion 101 is present.

Therefore, the length of the groove-like recess portion 33 becomes uniform over an entire region of the row 33*a* and a forming accuracy of the step of forming the groove-like recess portion 33 is promoted. In accordance therewith, the volume of the pressure generating chamber 29 is made to be uniform and the characteristic of ejecting ink from each nozzle opening 48 can be ensured to be normal. Further, also a working load for the respective projected portions 53, 53*c* constituting the male dies in forming the groove-like recess portion 33 is made to be uniform and therefore, wear or damage of the die can considerably be reduced. Further, since the end portions of the groove-like recess portions 33 are aligned on the imaginary line O-O, a forming accuracy of the communication port 34 formed at the end portion of the groove-like recess portion 33 is promoted and at the same time, wear or damage of the boring punches 37*a*, 38*a* for forming the communication port 34 can considerably be reduced.

According to an example shown in FIGS. 10(*d*), (*e*), the recess groove portion 71 is partially narrowed in a width thereof as the highly rigid portion 100. Notation 102 designates a narrow width portion, width narrowing working is carried out for narrowing the width and therefore, an amount of the material of the portion moved to the side of the recess groove portion 71 is reduced and as shown by notation 103 in FIG. 10(*e*), a portion of reducing the material moving amount is formed. The portion 103 of reducing the material moving amount achieves a function as the highly rigid portion 100 and therefore, the highly rigid portion 100 is provided to deal with a region in which the end portion on the side of the recess groove portion 71 of the groove-like recess portion 33 of the pressure generating chamber forming plate 30 is liable to be projected partially to the side of the recess groove portion 71 to thereby restrain the end portion from being projected to the side of the recess groove portion 71, a region at which the end portion is not projected to the side of the recess groove portion 71 is not provided with the highly rigid portion 100 and therefore, as a result, the end portions of the groove-like recess portions 33 on the side of the recess groove portion 71 are aligned on the imaginary line O-O. Otherwise, the constitution is similar to that of the example of the shallow bottom portion 101 and similar portions are attached with the same notations. Further, also the example achieves operation and effect similar to those of the example of the shallow bottom portion 101.

According to an example shown in FIGS. 11(*f*), (*g*), a plurality of opening portions 104 extended in the longitudinal direction of the recess groove portion 71 are formed at the bottom portion of the recess groove portion 71 and an unopened portion 105 which is not opened with the opening portion 104 constitutes the highly rigid portion 100. The opening portion 104 in this example is formed in the step of forming the recess groove portion 71 in place of the step of boring the rigid hole 71*a* at the tenth stage S10 in the fourth step. Otherwise, the constitution is similar to those of the examples of the shallow bottom portion 101 and the narrow width portion 102, and similar portions are attached with the same notations. Further, also the example achieves operation and effect similar to those of the examples of the shallow bottom portion 101 and the narrow width portion.

Further, although not illustrated, by combining the structure of FIGS. 10(*b*), (*c*) and the structure of FIGS. 11(*f*), (*g*), that is, by arranging the shallow bottom portion 101 at the unopened portion 105, a rigidity of the highly rigid portion 100 can be set to be higher in view of a relative relationship with other portion.

The shallow bottom portion 101, the narrow width portion 102 and the opening portion 104 or the like can be formed by providing a predetermined forming die shape at the forming projected streak 71*a* and the recess groove 71*b* shown in (A3) of FIG. 10(*a*).

Although the imaginary line O-O on which the end portions of the groove-like recess portions 33 are aligned is constituted by the linear line, the imaginary line O-O can also be constituted by a curved line of a shape of a circular arc as necessary. Further, as is apparent from the above-described respective examples, the highly rigid portion 100 is a portion at which the rigidity of a portion of the strip 55 is relatively set to be higher than that of the other portion.

Alignment of the end portions and the small recess portion on the imaginary line O-O as described above is applicable to a case of working a small recess portion or a small hole in pressing a laminated metal cavity, pressing an ink nozzle plate and pressing an ink jet filter or the like as cases other than working the groove-like recess portion 33.

Operation and effect of the embodiment of the method of working the small recess portion will be described as follows.

That is, according to the method of working the small recess portion of the invention, the imaginary line O-O extended in the row direction along the end portions of the portions predicted to be pressed to which the predetermined number of pieces of the aligned projected streaks 53, 53*c* are pressed is set, the highly rigid portion 100 is previously formed at a vicinity of the imaginary line O-O, thereafter, the projected streak portions 53, 53*c* are pressed to the pressure generating chamber forming plate 30 and therefore, the flow of the metal material in a transient stage of forming the groove-like recess portion 33 is restrained by the highly rigid portion 100, and the end portions of the groove-like recess portions 33 are formed in a state of being aligned regularly on the imaginary line O-O. Therefore, a number of the extremely small groove-like recess portions 33 which are made to be difficult to promote forming accuracy can easily be formed in a state of being aligned on the imaginary line O-O having the predetermined shape. By such an advantage, the shape of the recess portion and the volume of the recess portion of the groove-like recess portion 33 can be provided as predetermined values thereof and the advantage is extremely preferable when the pressure generating chamber 29 of the recording head 1, 1' is constituted by pressing or the like.

The highly rigid portion 100 is a portion at which one portion of the region of the pressure generating chamber forming plate 30 along the imaginary line O-O is provided with a rigidity relatively higher than that of the other portion and therefore, the portion having the relatively high rigidity may be formed along the imaginary line O-O and the highly rigid portion 100 can extremely simply be formed. That is, the highly rigid portion 100 may be formed by increasing the rigidity of the predetermined portion and leaving the rigidity of other portion as it is or reducing the rigidity of the other portion, further, the highly rigid portion 100 may be formed by reducing the rigidity of the predetermined portion and leaving the rigidity of other portion as it is or increasing the rigidity of the other portion, and in this way, the highly rigid portion 100 can simply be provided by the above-described relativity.

The highly rigid portion 100 is provided in the recess groove portion 71 formed along the imaginary line O-O and therefore, the highly rigid portion 100 can be formed in the recess groove portion 71 simultaneously with forming the recess groove portion 71, and the step of forming the highly rigid portion 100 is simplified. Further, since the recess groove portion 71 is formed along the imaginary line O-O, the highly rigid portion 100 formed in the recess groove portion 71 is facilitated to arrange at the predetermined position and the position relative to the imaginary line O-O is easy to be made proper.

The highly rigid portion 100 is constituted by the shallow bottom portion 101 formed by shallowing the depth of a portion of the recess groove portion 71 and therefore, the wall thickness of the shallow bottom portion 101 becomes larger than that of other portion and the function as the highly rigid portion 100 is achieved. Further, the highly rigid portion 100 is formed by only shallowing the depth of the recess groove portion 71 and therefore, working is simplified by simple pressing.

The highly rigid portion 100 is the narrow width portion 102 formed by narrowing the width of a portion of the recess groove portion 71 and therefore, by working to narrow the width of the narrow width portion 102, the metal material of an amount larger than that of other portion of the recess groove portion 71 is made to be difficult to flow in the narrow width direction. Therefore, by providing the highly rigid portion 100 to deal with the region in which the end portion of the groove-like recess portion 33 of the pressure generating chamber forming plate 30 on the side of the recess groove portion 71 is liable to be projected to a side of the recess groove portion 71, the end portion is restrained from being projected to the side of the recess groove portion 71, the highly rigid portion 100 is not provided at the region in which the end portion is not projected to the side of the recess groove portion 71 and therefore, as a result, the end portions of the groove-like recess portions 33 on the side of the recess groove portion 71 are aligned on the imaginary line O-O.

The highly rigid portion 100 is the unopened portion 105 formed by providing the opening portion 104 at the bottom portion of the recess groove portion 71 and therefore, the opening portion 104 can be formed by the simple pressing step in forming the recess groove portion 71 and the unopened portion 105 for constituting the highly rigid portion 100 can simply be worked.

The highly rigid portion 100 is provided at the vicinity of the row end of the portion predicted to be pressed in the row-like shape pressed by the respective projected streak portions 53, 53*c*. Although it seems that the alignment of the groove-like recess portions 33 formed at the vicinity of the row end is liable to be brought into an abnormal mode by the state of making the metal material at the vicinity of the row end of the projected portion 53, 53*c* flow or a pressing condition, the highly rigid portion 100 is arranged to adapt to the portion which is liable to show the abnormality in this way and therefore, the abnormal mode can be restrained from being brought about.

Since the imaginary line O-O is constituted substantially by the linear line, the end portions of the groove-like recess portions 33 can accurately be aligned along the imaginary linear line and the shape of the groove-like recess portion 33 and the volume of the recess portion are facilitated to be made uniform.

Since the small recess portions are constituted by the groove-like recess portions 33 aligned in parallel with each other, the metal material is restrained from flowing in the longitudinal direction of the groove-like recess portion 33 by the highly rigid portion 100 and the end portion of the groove-like recess portion 33 can accurately be formed along the imaginary line O-O.

Further, according to the method of fabricating the recording head 1, 1' of the invention, prior to forming the small groove-like recess portions 33 of the pressure generating chamber forming plate 30 in the aligned state, the highly rigid portion 100 is formed at the predetermined position at the vicinity of the imaginary line O-O extended in the row direction along the end portions of the portions predicted to be pressed to which the respective projected streak portions 53, 53*c* are pressed previously at the pressure generating chamber forming plate 30 and therefore, the flow of the metal material at a transient stage of forming the groove-like recess portions 33 is restrained by the highly rigid portion 100 and the end portions of the groove-like recess portions 33 are formed in the state of being regularly aligned along the imaginary line O-O. Therefore, a number of the extremely small groove-like recess portions 33 which are made to be difficult to promote the forming accuracy can be formed by being aligned on the imaginary line O-O having the predetermined shape easily. Therefore, the shapes and the volumes of the respective pressure generating chambers 29 of the recording head 1, 1' can be set to be uniform and a characteristic of ejecting ink drops can be stabilized.

Operation and effect of the recording head according to the invention are as follows.

That is, since the highly rigid portion 100 is provided in the pressure generating chamber forming plate 30 at the predetermined portion of the vicinity of the imaginary line O-O extended in the row direction along the end portions of the groove-like recess portions 33 in the row-like shape and therefore, the groove-like recess portion 33 restraining flow of the metal material in forming by the highly rigid portion 100 is provided, the shapes and the volumes of the respective pressure generating chambers 29 of the recording head 1, 1' can be set will be uniform and a characteristic of ejecting ink drops can be stabilized.

The situation of tentatively forming the groove-like recess portion 33 by the tentatively forming die 56 and finish forming by the finish die 57 in S5 and S6 of the "second step" will be explained further in details in reference to FIG. 23 through FIG. 25.

Further, when the strip (material) 55 is plastically deformed by the male die 51 and the female die 52 under a normal temperature condition, further, also in plastic deformation explained below, similarly, plastic deformation is carried out under a normal temperature condition.

A male 51*a*, that is, a first die is aligned with a number of forming punches 51*b*. In order to form the groove-like recess portion 33, the forming punch 51*b* is deformed slenderly to constitute a projected streak portion 53*c*. Further, the projected streak portions 53*c* are aligned in parallel by a predetermined pitch. Further, in order to form the partition wall portion 28, the gap portions 53*b* (refer to FIG. 16, FIG. 18) is provided between the forming punches 51*b*. FIG. 24(*c*) shows a state of pressing the first die 51*a* to the pressure generating chamber forming plate 30 (55) constituting the material.

On the other hand, the female die 52*a*, that is, a second die is provided with a recess portion 54*a* extended in the direction of aligning the projected streak portions 53*c* at portions thereof in correspondence with middle portions in the longitudinal direction of the projected streak portion 53*c*. Further, two kinds of dies of a tentatively forming die 56 and a finishing die 57 of the second die 52*a* are prepared.

The second die 52*a* is provided with the tentatively forming die 56 for tentatively forming and the finishing die 57 for finishing to work after tentative forming by the tentatively forming die 56 and therefore, the material 55 is made to flow into the gap portion 53*b* by the tentatively forming die 56, thereafter, a distribution of the material 55 in the gap portion 53*b* is made to be as proximate to the normal state as possible by the finishing die 57 and therefore, the amount of making the material flow into the gap portion 53*b* is brought into a state of being substantially straight in the length direction of the gap portion 53*b*, which is preferable when the portion is made to function as a member such as, for example, the partition wall portion 28 of the pressure generating chamber 29 of the liquid ejection head 1.

Constitution and operation of the second die 52*a* will be described in details as follows.

The tentatively forming die 56 is formed with a streak-like projection 54 opposed to the projected streak portion 53*c* and having a length substantially the same as that of the projected streak portion 53*c*. Further, the streak-like projection 54 is provided with a recess portion 54*a* a height of a middle portion in a length direction of which is set to be low. As shown by FIG. 24(*a*), the recess portions 54*a* in a shape of a circular arc are formed at center portions of a number of the aligned streak-like projections 54.

Figure 24:
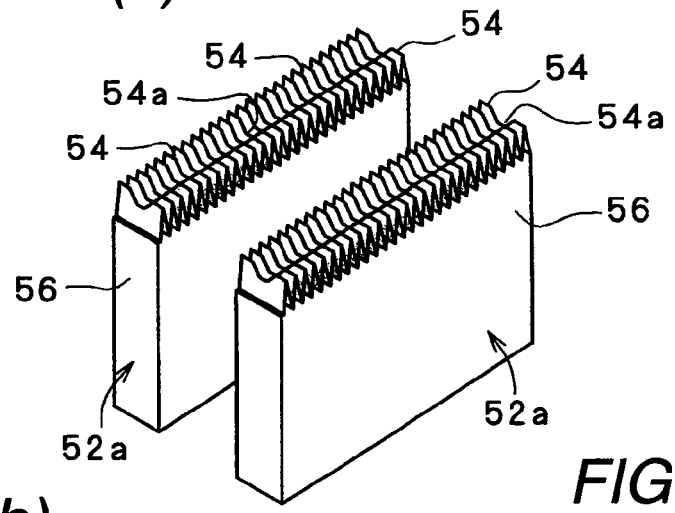
FIG. 24 illustrates a perspective view and sectional views showing a state of proceeding tentative forming.
Figure 24:
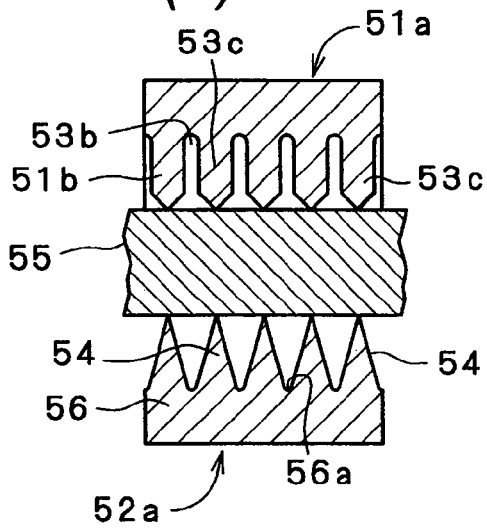
Figure 24:
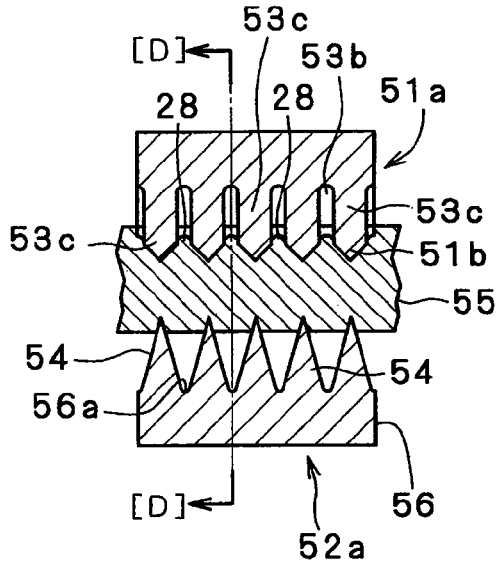
Figure 24:
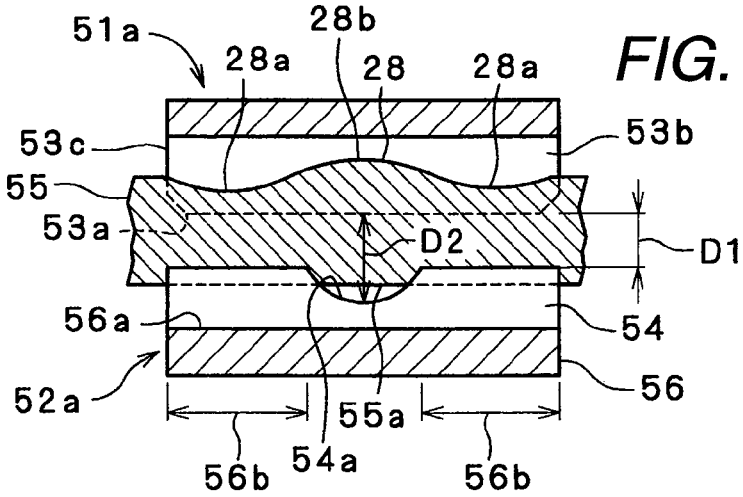

Although the streak-like projection 54 shown in FIG. 17 and FIG. 18 is constituted by a member shape as in that of a projected streak having a low height, in order to form the recess portion 54*a*, a required height as shown by FIG. 24 is needed for the streak-like projection 54. Therefore, as the streak-like projections 54 formed with the recess portions 54*a*, a number of "projected streaks" having a height are aligned in parallel and therefore, in FIG. 24, a sectional shape thereof is constituted by a shape of a wedge having a sharp front end. The wedge angle of the wedge shape portion is constituted by an acute angle equal to or smaller than 90 degrees. Further, valley portions 56*a* are formed by aligning the streak-like projections 54. Further, a raised portion 55*a* formed by a tentatively forming step, mentioned later, is illustrated at the rear face of the pressure generating chamber forming plate 55.

A length of the recess portion 54*a* in the longitudinal direction of the streak-like projection 54 is set to be equal to or smaller than about ⅔ of the length of the streak-like projection 54. Further, the pitch of the streak-like projection 54 is 0.14 mm. With regard to the pitch of the streak-like projections 54, by making the pitch equal to or smaller than 0.3 mm, in working of a part of the liquid ejection head or the like, the part is preparatorily formed further preferably. The pitch is preferably equal to or smaller than 0.2 mm, further preferably equal to or smaller than 0.15 mm. Further, a surface of a portion of at least the recess portion 54*a* of the streak-like projection 54 is finished smoothly. Although as the finish, the mirror finish is preferable, otherwise, the surface may be subjected to chromium plating.

Next, since the finishing die 57 of the second die 52*a* is used after tentative forming by the tentatively forming die 56, the finishing die 57 is formed with a flat face 57*a* removing the streak-like projection 54 of the tentatively forming die 56, further, a containing recess portion 57*b* is formed at a portion in correspondence with the recess portion 54*a* of the tentatively forming die 56. That is, in view from a width direction of a forming face of the finishing die 57, a center portion is formed with the containing recess portion 57*b* and the flat faces 57*a* are provided on both sides of the containing recess portion 57*b*.

The flat face 57*a* is constituted by a surface shape in which a portion thereof at a vicinity of an end portion in the direction of aligning the projected streak portions 53 becomes low to the end portion. The surface shape shown in FIG. 25(*a*) is constituted by an inclined face 57*c* continuous to the flat face 57*a*.

The first die 51*a* and the second die 52*a* are fixed to a normal forging apparatus (not illustrated) for operating to move forward and rearward the dies, and working is successively carried out by arranging the pressure generating chamber forming plate 30 (55) between the two dies 51*a* and 52*a*. Further, since the second die 52*a* is constituted by a set of the tentatively forming die 56 and the finishing die 57 and therefore, it is pertinent to align the tentatively forming die 56 and the finishing die 57 contiguously to each other and successively moving the pressure generating chamber forming plate 30 (55).

Next, an explanation will be given of working operation of a forging punch constituted by the first die 51*a* and the second die 52*a*.

According to the metal material plate 55 pressed between the two dies 51*a*, 52*a*, the material 55 is moved to flow to be pressed into the gap portion 53*b* of the first die 51*a*. At this occasion, the second die 52*a* is provided with the recess portion 54*a* the height of the middle portion of which is made to be low and therefore, the portions 56*b*, 56*b* (refer to FIG. 24(*d*)) proximate to the end portions of the second die 52*a* on the both sides of the recess portion 54*a*, an interval D1 between the two dies 51*a*, 52*a* is made to be narrower than an interval D2 of a middle portion (recess portion) thereof and an amount of pressing the material is increased at the narrow portion. The metal material plate 55 pressed in this way is made to flow to be extruded in a direction substantially orthogonal to the pressing direction, and more of the material is moved to a side of the recess portion 54*a* having the wider interval between the two dies 51*a*, 52*a* and having the small pressing amount. In other words, in flow of the material, the recess portion 54*a* achieves a function of providing a location of escaping the material 55. The material flows mainly along the longitudinal direction of the projected streak portion 53*c* or the gap portion 53*b*, further, a portion of the material 55 constitutes the raised portion 55*a* bulged to the side of the recess portion 55*a*.

Therefore, at the portion 56*b* having a large pressing amount, by strongly pressing the material, the material positively flows more to the recess portion 54*a* having a small pressing amount and therefore, much of the material flows to the gap portion 53*c* of a portion in correspondence with the recess portion 54*a*. In this way, the material is made to flow over an entire region of the gap portion while directing flow of the material to a side of the recess portion 54*a* at the both sides 56*b*, 56*b*. Further, since the projected streak portions 53*c* are aligned at the predetermined pitch, a phenomenon of making the material flow in the aligning direction (width direction of the projected streak portion) by pressing by the respective projected portions 53*c* is made to be uniform in both of the flowing direction and the flowing amount. The flow of the material 55 based on the predetermined pitch contributes to making the material flow uniformly to the respective gap portions 53*b* without disturbing the phenomenon of flowing in the longitudinal direction of the air gap portions 53*b*.

The material 55 flowing into the air gap portion 57*b* constitutes the partition wall portion 28 of the groove-like recess portion 33 and therefore, the shape of the space of the groove-like recess portion 33 can accurately be formed. Further, as forming to work the small structure, generally, a method of anisotropic etching is adopted, according to the method, a number of working steps is increased and therefore, the method is disadvantageous in view of fabrication cost. In contrast thereto, when the forging punch is used for the material made of a metal of nickel or the like, a number of working steps is considerably reduced, which is extremely advantageous in view of cost. Further, the volumes of the respective groove-like recess portions 33 can be worked uniformly and therefore, in forming the pressure generating chamber of the liquid ejection head, the method is very effective in view of stabilizing the ejection characteristic of the liquid ejection head.

Although the above-described working operation has been explained by emphasizing on an operational function of the recess portion 54*a* of the second die 52*a*, an operational function by the illustrated streak-like projection 54 and the recess portion 54*a* is as follows. FIG. 24(*b*) shows a state immediately before pressing the material 55 between the first die 51*a* and the second die 52*a*. When the material 55 is pressed between the two dies 51*a*, 52*a* as shown by FIG. 24(*c*), (*d*) from the state, simultaneously with pressing the streak-like projection 54 to pierce into the material 55, the material is made to flow into the gap portion 53*b* and the partition wall portion 28 is tentatively formed.

In the stage of tentative forming, by the recess portion 54*a* of the streak-like projection 54, similar to the above-described case, much of the material 55 is made to flow to the side of the recess portion 54*a* at which a pressing amount is small and therefore, much of the material is made to flow also to the gap portion 53*b* at a portion in correspondence with the recess portion 54*a*. In this way, much of the material is made to flow over the entire region of the gap portion 53*b* while directing flow of the material to the side of the recess portion at both sides 56*b*, 56*b* of the recess portion 54*a*. Further, by synergetically operating a projection height of the streak-like recess projection 54 per se, more of the material 55 is positively pressed into the gap portion 53*b*. With regard to a height of the partition wall portion 28 in the tentatively formed state, as shown by FIG. 24(*d*), low portions 28*a*, 28*a* and a high portion 28*b* are formed. Such a difference in height is produced because the material 55 pressed at the portions 56*b*, 56*b* proximate to the end portions is made to flow more to a portion of the recess portion 54*a* and at that occasion, much of the material is made to flow into the gap portion 53*b*.

Figure 25:
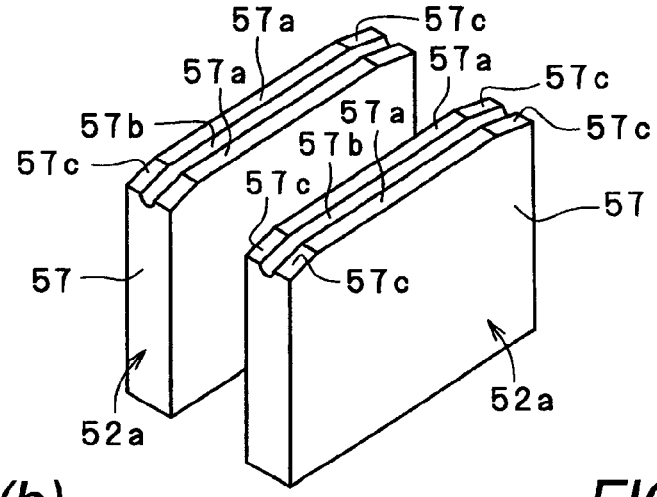
FIG. 25 illustrates a perspective view and sectional views showing a state of proceeding finish forming.
Figure 25:
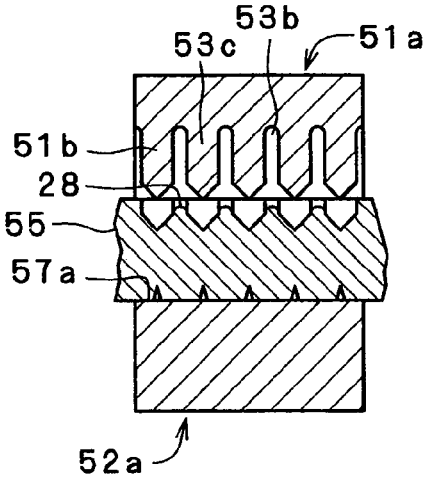
Figure 25:
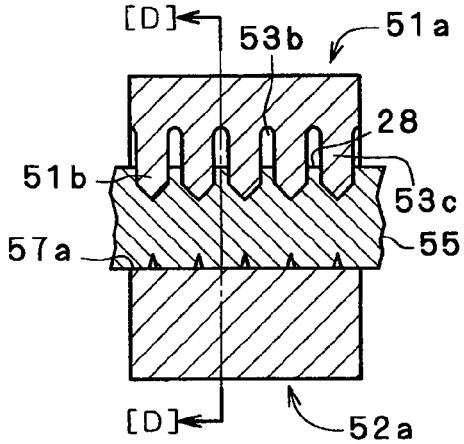
Figure 25:
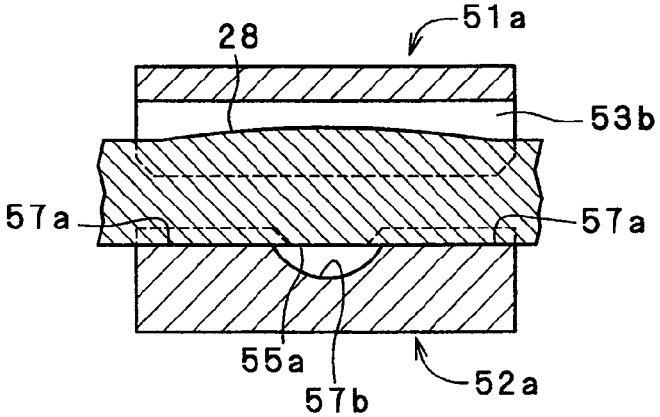

When tentative forming shown by FIGS. 24(*c*), (*d*) has been finished, as shown by FIG. 25(*b*), the material 55 in the tentatively formed state is transferred to between the first die 51*a* and the finishing die 57, where the material 55 is pressed by the two dies 51*a*, 52*a* as shown by FIG. 25(*c*). The finishing die 57 is formed with the flat faces 57*a* on both sides of the containing recess portion 57*b* and therefore, an amount of making the material 55 flow into the air gap portion 53*b* at the low portions 28*a*, 28*a* of the partition wall portion is increased and the height of the portions 28*a*, 28*a* is heightened. At this occasion, the raised portion 55*a* is contained in the containing recess portion 57*b* and is not exerted with a pressing force from the finishing die 57 and therefore, the height of the high portion 28*b* is hardly changed. Therefore, finally, as shown by FIG. 25(*d*), the height of the partition wall portion 28 becomes substantially a uniform height.

Further, at the stage of finish forming, since the inclined face 57*c* is formed, amounts of making the material 55 flow into the respective gap portions 53*b* are made to be as uniform as possible in all of the gap portions 53*b*. That is, the material 55 flowing in a direction of aligning the projected streak portions 53 flows little by little from a center portion of the alignment of the projected streak portions 53 to the sides of the end portions to bring about an integrally deviated state and vicinities of the end portions are brought into a so-to-speak large wall state. The material integrally deviated in this way is pressed by the lowered inclined face 57*c* and therefore, a material in the large wall state is prevented from excessively flowing into the gap portion 53*b*. Therefore, the amounts of making the material 55 flow into the respective gap portions 53*b* can be made as uniform as possible in all of the gap portions 53*b*.

The streak-like projection 54 is constituted by the wedge shape having the sharpened front end and therefore, the portion of the wedge shape firmly bites the material 55 and therefore, the material 55 at the portion opposed to the gap portion 53*b* can accurately be pressed and the material is firmly made to flow to the gap portion 53*b*. Further, by constituting the wedge angle by so-to-speak acute angle equal to or smaller than 90 degrees, biting of the wedge shape portion to the material 55 is further firmly be achieved. By making the pitch of the streak-like projection 54 equal to or smaller than 0.3 mm, the pressure generating chamber of the ink jet type recording head can be fabricated by extremely exquisite forging by the forging punch.

By constituting the recess portion 54*a* by a shape of a recess portion in a circular arc shape, a height of a middle portion of the second die is gradually changed and therefore, the amount of the material 55 flowing into the gap portion 53*b* is made to be as uniform as possible in view from a length direction of the gap portion 53*b*. Further, by constituting the recess portion 54*a* by a shape of a recess portion constituted by a plurality of planes, by selecting angles of inclining the planes, the height of the middle portion of the second die can be made to change gradually and the amount of the material 55 flowing into the gap portion 53*b* can be made to be as uniform as possible in view from the length direction of the gap portion 53*b*.

When a raised shape portion is provided at a middle portion of the recess portion 54*a*, at a portion proximate to the raised shape portion and the end portion of the second die 52*a*, the interval between the two dies 51*a*, 52*a* (corresponding to the interval D1) is narrowed, the recess portion 54*a* is constituted by a plurality of portions and therefore, pluralities of portions having large pressing amounts and portions having small pressing amounts are alternately arranged. Therefore, the portions having large pressing amounts (corresponding to the side 56*b*) and the recess portions 54*a* constituting destinations of flow of the material 55 are alternately arranged bit by bit and therefore, the amounts of the material 55 flowing to the gap portions 53*b* is made to be substantially uniform in view from the length direction of the air gap portions 53*b*.

By setting the length of the recess portion 54*a* in the longitudinal direction of the streak-like projection 54 to about ⅔ or less of the length of the streak-like projection 54, a material flowing amount in a direction substantially orthogonal to the pressing direction and a space of the recess portion 54*a* for receiving the material can pertinently be balanced in view of a balance with a size of a pressing stroke and flow of the material into the air gap portion 53*b* is optimized.

A surface of a portion of at least the recess portion 54*a* of the streak-like projection 54 is finished smoothly by mirror finish, chromium plating or the like and therefore, at the recess portion 54*a*, the material 55 flowing in the direction substantially orthogonal to the pressing direction is positively diverted to a side of the air gap portion 53*b* by the smooth surface state and a material further positively flows into the air gap portion 53*b*.

Forming of the groove-like recess portion 33 and the like is as described above.

Here, in order to integrally integrate the plate-like part formed with the groove-recess portion 33, that is, the pressure generating chamber forming plate 30 with the elastic plate 32, the nozzle plate 31 and the like to finish as the flow path unit 4, the respective parts need to be provided with positioning shape portions for ensuring integration accuracy.

Hence, according to the embodiment, there is carried out working capable of ensuring a highly accurate positional relationship among the groove-like recess portion 33, the integrating reference holes 73 and the communication port working pilot hole 72. That is, the positioning shape portions are formed by a rational forging method in view of a relationship with shape portions other than the positioning shape portions. Further, according to the invention, in working the plurality of shape portions, the positioning shape portion is finally worked and working of other than the positioning shape portion is constituted by working of other shape portion which is carried out prior to the final working.

An explanation will be given of a case of forming the positioning shape portion at the pressure generating chamber forming plate 30 as an example as follows.

The pressure generating chamber forming plate 30 constituting the metal material made of nickel is formed with the groove-like recess portion 33 having the recess shape constituting the shape portion other than the positioning shape portion, further, formed with a reference hole in a shape of a through hole constituting the positioning shape portion.

FIG. 26 through FIG. 29 show an embodiment of a forging method for forming the positioning shape portion and a method of fabricating the liquid ejection head. Further, portions achieving functions the same as those of the portions which have been explained are described by the same notations in the drawings.

Further, when plastic deformation is carried out at the strip (material) 55 by the male die 51 and the female die 52, the plastic deformation is carried out under a normal temperature condition, further, also with regard to plastic deformation explained below, the plastic deformation is carried out similarly under the normal temperature condition.

Figure 27:
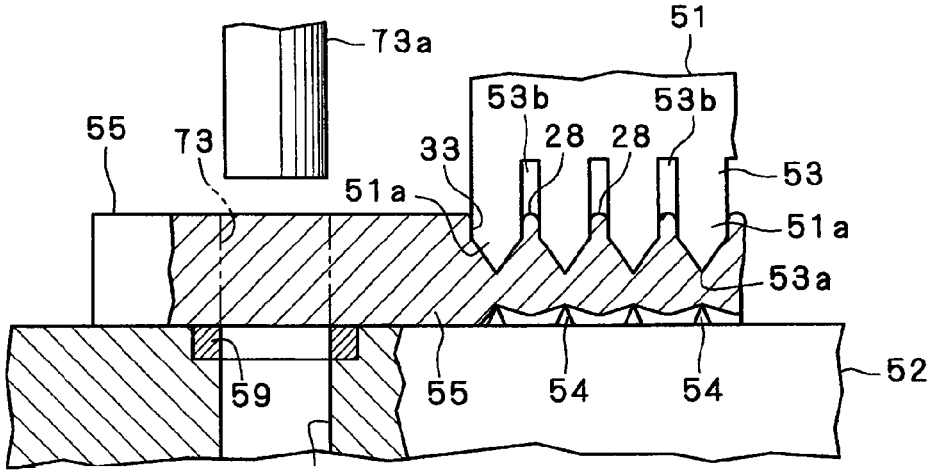
FIG. 27 is a sectional view showing a state of proceeding to form the groove-like recess portion.

The male die 51 is arranged with a number of the forming punches 51*b*. In order to form the groove-like recess portion 33, the forming punch 51*b* is slenderly deformed to constitute the projected streak portion 53. Further, in order to form the partition wall portion 28, the gap portion 53*b* (refer to FIG. 16, FIG. 18) is provided between the forming punches 51*b*. FIG. 27 shows a state of pressing the male die 51 to the pressure generating chamber forming plate 30 constituting the material.

According to the embodiment, as shown by FIG. 27, a forming die of the reference hole 73 is provided by enlarging the female die 52 (on the left side of the drawing). A boring punch 73*a* for boring the reference hole 73 at the pressure generating chamber forming plate 30 is arranged at a portion thereof comparatively proximate to the male die 51, an opening 58 is provided at a portion of the female die 52 in correspondence therewith, and a die 59 is arranged at an opening end of the opening 58. The boring punch 73*a* advances to press the pressure generating chamber forming plate 30 to the die 59 to form the reference hole 73 by shear punching.

The reference hole 73 and the boring punch 73 correspond to the integrating reference hole 73 and the boring punch 73*a* for boring the integrating reference hole 73 at the sixth stage S6 shown in FIG. 12.

A forging machine used here is of a general type for operating (for example, double action) a plurality of dies simultaneously or successively. The male die 51 is coupled to a first driving unit (not illustrated) of the forging machine, further, the boring punch 73*a* is coupled to a second driving unit (not illustrated) of the machine. The strip 55 made of nickel to be fed successively is mounted on the female die 52 of the forging machine as a metal material of a plate-like member. Further, as is understood through the total of the explanation, the strip 55 is the metal material and at the same time, the same as that of a material referred to as the pressure generating chamber forming plate 30, a material, a metal material plate, a plate-like member or the like.

By the above-described constitution, the male die 51 brought into a stationary state at a maximum stroke position is brought into a state of being pressed to a position at which the groove-like recess portion 33 constituting the other shape portion has been formed, flow of the metal material has been finished under the stroke state and also stresses in accordance therewith are completely nullified. The boring punch 73*a* for executing final working starts working after nullifying influence on a vicinity of a periphery produced in forming the groove-like recess portion 33 in this way and therefore, at the time points in the midst of working and of finishing to work, the integrating reference hole 73 is formed by the final working without being exerted with any external force. Therefore, the shape portion by the final working and the other shape portion worked prior thereto are formed in a correct positional relationship and a shape as predetermined and a plurality of kinds of highly accurate shape portions are provided.

On the other hand, when the boring punch 73*a* for executing the final working executes the forming operation, the male die 51 stays to be brought into the groove-like recess portion 33 formed prior thereto and therefore, even when flow of the metal material produced in the final working and stresses in accordance therewith effect an influence on the groove-like recess portion 33, since the male die 51 brought into the groove-like recess portion 33 serves as a base member of a core bar or the like, an adverse influence of deforming the shape portion can be prevented.

The groove-like recess portion 33 worked prior thereto is the shape portion having a high fineness, the integrating reference hole 73 worked in the final working is the shape portion having a fineness lower than that of the shape portion having the high fineness and therefore, the groove-like recess portion 33 having the high fineness and difficult to promote the forming accuracy is worked prior thereto, thereafter, the integrating reference hole 73 having the low fineness is formed and therefore, the final working having the low fineness is executed after ensuring the working state of the shape portion having the high fineness at the maximum stroke position of the male die 51. Therefore, boring of the final working is carried out after finishing to form the groove-like recess portion of the portion which is difficult to promote the forming accuracy prior thereto and therefore, forming quality of the shape portion having the high fineness can be ensured at a level as predetermined.

A plurality of kinds of the shape portions of the groove-like recess portion 33, the integrating reference hole 73 and the like are worked in the same working stage and therefore, the plurality of kinds of shape portions are formed in the same working stage including boring of final working while setting the metal material in the forging machine and therefore, the relative positions of the respective shape portions are correctly provided. That is, the plurality of kinds of dies mounted to the forging machine are pressed to the metal material 55 brought into the stationary state simultaneously or successively and therefore, during a time period of forming the respective shape portions, the metal material 55 is not moved and the positional relationship among the respective shape portions can accurately be set. Further, the number of working steps can be reduced, which is advantageous in view of fabrication cost.

The metal material 55 is penetrated by the final working and therefore, after finishing flow of the metal material 55 in forming the other shape portions of the groove-like recess portion 33 and the like and completely nullifying stresses in accordance therewith, the integrating reference hole 73 penetrating the metal material 55 is worked to form and therefore, the position and the shape of the penetrated integrating reference hole 73 are correctly and accurately formed. Further, in working to form the penetrated integrating reference hole 73, the flowing amount of the metal material 55 and the stresses generated at that occasion are increased, however, forming of the groove-like recess portion 33 is brought into a stable state and therefore, an adverse influence is not effected to the shape portion of the groove-like recess portion 33.

When the metal material 55 is a plate-like member for constituting a part, for example, in forming the pressure generating chamber forming plate 30 of the recording head 1 by forging, the groove-like recess portion 33 for the pressure generating chamber 29 requested to be worked finely can be previously formed, thereafter, the integrating reference hole 73 can be worked to bore, the highly accurate groove-like recess portion 33 can be formed, the hole can be bored at the accurate position, finally, the highly accurate pressure generating chamber forming plate 30 can be provided.

As described above, a plurality of kinds of shape portions of the reference hole 73, the groove-like recess portion 33 and the like are formed in the same working stage while setting the metal material 55 to the forging machine and therefore, the relative positions of the reference hole 73 and the groove-like recess portion 33 can correctly be provided. That is, the plurality of kinds of dies mounted to the forging machine are fed successively to be pressed to the metal material 55 simultaneously or successively and therefore, during a time period of forming the reference hole 73 and the groove-like recess portion 33, the metal material 55 is not moved and the positional relationship between the reference hole 73 and the groove-like recess portion 33 can accurately be set. Further, the number of working steps can be reduced, which is advantageous in view of fabrication cost.

Figure 28:
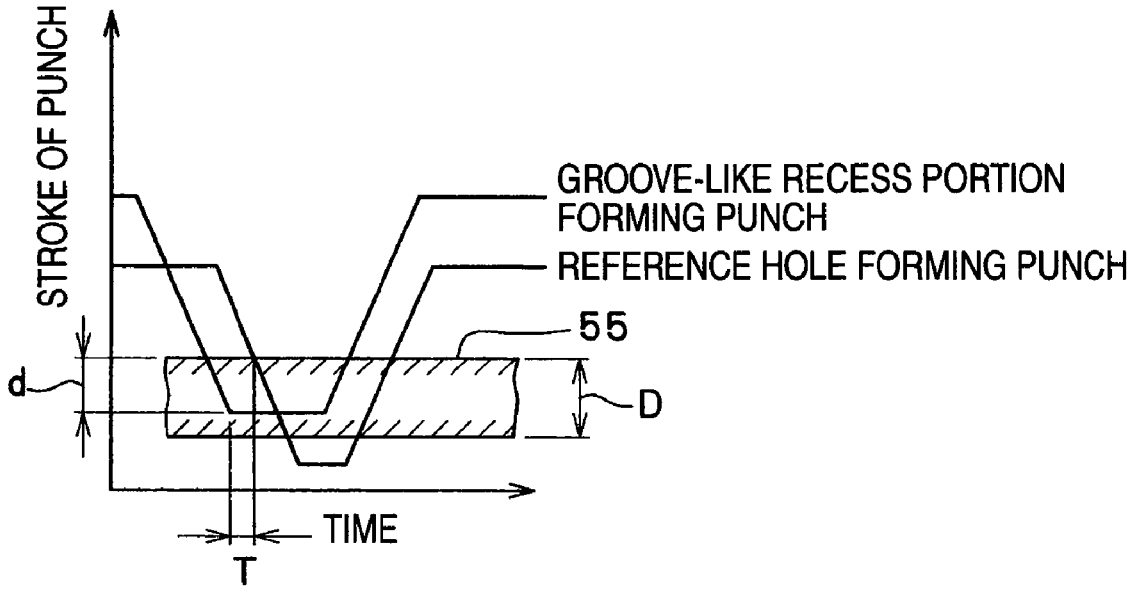
FIG. 28 is a line diagram showing timings of forming the groove-like recess portion and a reference hole.

FIG. 28 is an operation line diagram showing timings of forming operation of the male die 51 and the boring punch 73*a*. The forming punch 51*b* previously presses the strip 55 to form the groove-like recess portion 33 having a depth D. In a state in which the forming punch 51*b* is stationary at the maximum stroke position after having deformed the groove-like recess portion 33, the boring punch 73*a* advances to bore the reference hole 73. That is, the punching of the punch 72*a* is started after elapse of a predetermined time period T after pressing the forming punch 51*b* to the strip 55. Since the reference hole 73 is punched through, a stroke of the boring punch 73*a* exceeds a thickness D of the strip 55. Further, the delay time period T in this case is 0.5 second. By setting the delay time period, the flow of the material and the operation of stresses at the portion of forming the groove-like recess portion 33 are nullified to prepare the condition of working the reference hole 73.

The forming punch 51*b* brought into the stationary state at the maximum stroke position is brought into a state of being pressed to the position of having formed the groove-like recess portion 33, under the stroke state, the flow of the metal material has been finished and also stresses in accordance therewith are completely nullified. After previously nullifying the influence on the vicinity of the periphery produced in forming the groove-like recess portion 33 in this way, the boring punch 73*a* for forming the reference hole 73 starts working and therefore, at time points in the midst of working and of finishing to work, the reference hole 73 is formed without being exerted with any external force. Therefore, the reference hole 73 is formed at the correct position and by the shape as predetermined and a highly accurate positioning function is achieved.

On the other hand, when the reference hole 73 is formed, the forming punch 51*b* stays to be brought into the groove-like recess portion 33 and therefore, even when the flow of the metal material produced in forming the reference hole 73 and the stresses in accordance therewith effect an influence on the groove-like recess portion 33, the forming punch 51*b* brought into the groove-like recess portion 33 and the stresses in accordance therewith effect an influence of the groove-like recess portion 33, since the forming punch 51*b* brought into the groove-like recess portion 33 serves as the base member as in the core bar and therefore, the adverse influence of forming the groove-like recess portion 33 can be prevented.

The groove-like recess portion 33 is formed at a plurality of working stages including at least tentative forming and finish forming as described above and the reference hole 73 is formed at the final working stage in the plurality of working stages. Therefore, at the stage of the final working stage in the plurality of working stages, the reference hole 73 is formed under a situation in which the flow of the metal material 55 and the influence of the stresses in accordance therewith are reduced and therefore, an external force exerted to the portion of forming the reference hole 73 is reduced as small as possible and normal forming of the reference hole 73 is realized. Further, since the groove-like recess portion 33 is formed by the plurality of working stages of the tentative forming and the finish forming as described above, deformation and flow of the material 55 of the formed portion are promoted in steps. Therefore, the large internal stress does not remain in the material, which is preferable for forming the reference hole 73.

Figure 29:
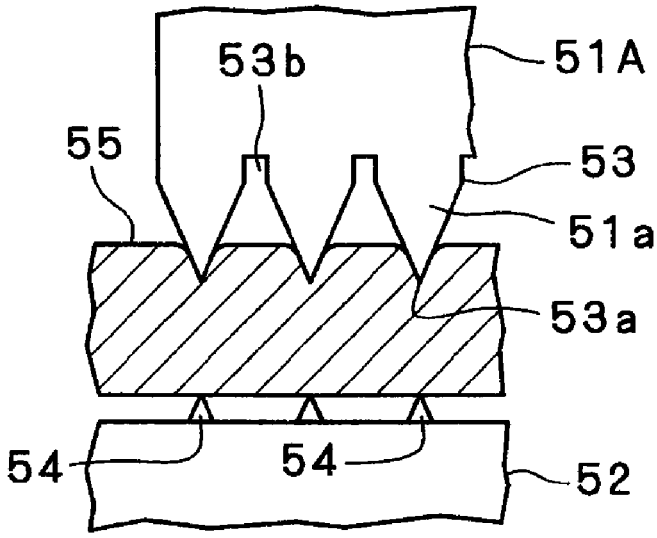
FIG. 29 illustrates sectional views showing tentative forming and finish forming.
Figure 29:
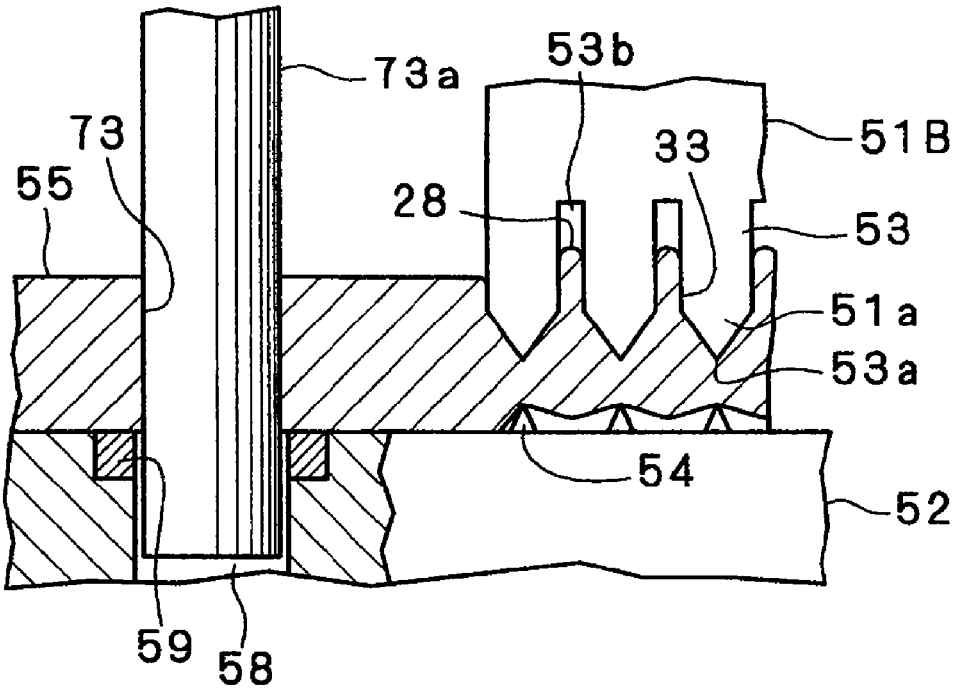

FIG. 29 shows a case of forming the groove-like recess portion 33 by the plurality of working stages including at least tentative forming and finish forming and forming the reference hole 73 at the final working stage of the plurality of working stages. FIG. 29(*a*) shows the tentatively forming step. A male die 51A used here is for tentative forming, constituting a sharp edge setting the angle of the front end portion 53*a* to be small and the depth of the gap portion 53*b* is small. In the tentative forming, as shown by FIG. 29(*a*), the forming punch 51*b* is comparatively shallowly pressed to execute preparatory forming.

Next, FIG. 29(*b*) shows the finish forming step. A male die 51B used here is for finish forming, the angle of the front end portion 53*a* is set to be large, and the depth of the gap portion 53*b* is set to be large. In the finish forming, as shown by FIG. 29(*b*), the forming punch 51*b* is deeply pressed to the strip 55 and the high partition wall portion 28 is formed in the gap portion 53*b*. In synchronism with the finish forming, the boring punch 73*a* advances to bore the reference hole 73. Further, although in the finish forming of FIG. 29(*b*), the streak-like projection 54 is arranged at the female die 52, the finishing die 57 having the flat face 57*a* shown in FIG. 25 can be used in place thereof.

By the above-described working operation, at the stage of tentative forming, the material 55 has already flowed and the stresses thereby have already been generated and therefore, at the final step, flow of the material 55 and generation of the stresses in accordance therewith are considerably reduced. By forming the reference hole 73 in synchronism with the final step of alleviating flow of the material and generation of the stresses, an adverse influence effected on forming of the reference hole 73 can be reduced to a substantially unproblematic level and the position of the shape of the reference hole 73 can be provided with the predetermined accuracy. Further, even when the flow of the material and the generation of the stresses in accordance with forming the reference hole 73 effect an influence on the portion of working the groove-like recess portion 33, the forming punch 51*b* for the final step stays to be brought into the material 55 and therefore, the forming punch 51*b* serves as the base material as in the core bar and adverse influence of deforming the shape of the groove-like recess portion 33 can be prevented.

Figure 26:
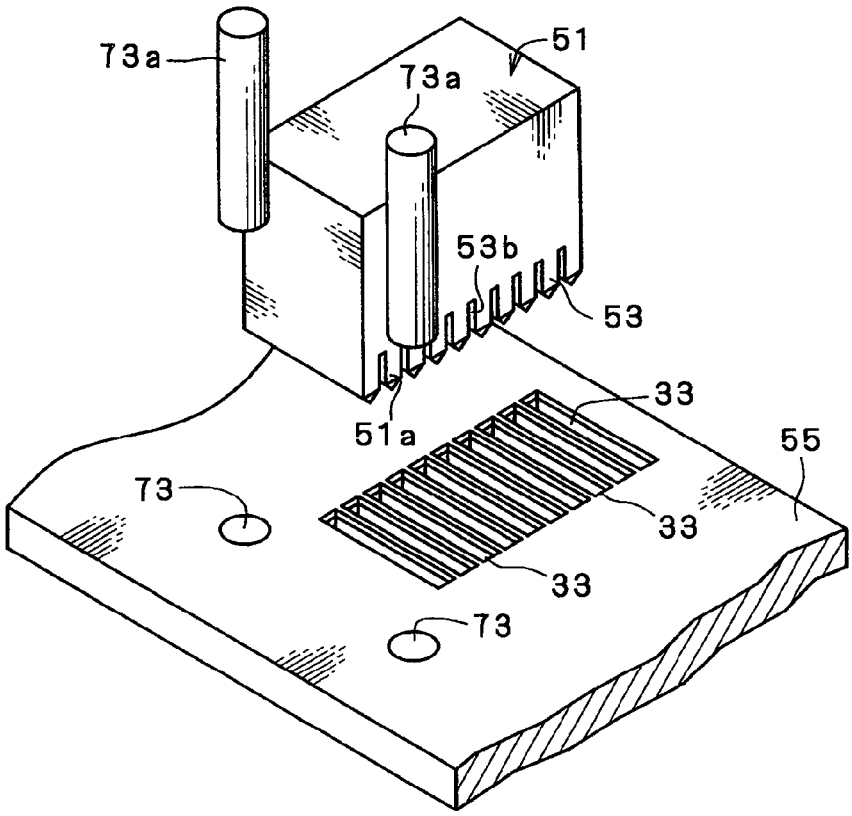
FIG. 26 is a perspective view showing a relationship between a die and a material.

As shown by FIG. 26, two pieces of the reference holes 73 are bored at the single pressure generating chamber forming plate 30. When the pressure generating chamber forming plate 30 is integrated to constitute the flow path unit 4, normally, the operation is carried out on an integrating jig in a shape of a base plate by laminating the pressure generating chamber forming plate 30 with the nozzle plate 31 and the elastic plate 32. The reference holes of the respective plate-like parts are fitted to positioning pins erected from the integrating jig and the flow path unit 4 is integrated by adhering or the like. At this occasion, also the reference hole 73 formed as described above is penetrated by the positioning pin along therewith to finish integration. Two pieces of the reference holes 73 are provided and therefore, the pressure generating chamber forming plate 30 penetrated with two pieces of the positioning pins are not shifted in any direction and accurate integration is carried out.

The groove-like recess portions 33 are aligned at the predetermined pitch. The relative positions of the groove-like recess portions 33 aligned by the predetermined pitch and the reference hole 73 are accurately set as described above and therefore, for example, in integrating the plurality of groove-like recess portions 33 to the elastic plate 32, the reference hole 73 achieves an intermediary function, the relative positions of the groove-like recess portions 33 and the ink supply port 45 are accurately set and excellent integration accuracy is achieved.

The pitch dimension of the groove-like recess portion 33 is 0.14 mm, and when the pressure generating chamber 29 of the ink jet type recording head constituting a fine small part is worked by the forging method, extremely exquisite forging can be carried out. Although the pitch of the groove-like recess portion 33 is 0.14 mm in the illustrated embodiment, by making the pitch equal to or smaller than 0.3 mm, in working a part of a liquid ejection head or the like, the part is finished preferably. The pitch is preferably equal to or smaller than 0.2 mm, further preferably equal to or smaller than 0.15 mm.

By constituting the plate-like member constituting the metal material 55 by the nickel plate, excellent effects are achieved such that the linear expansion coefficient of nickel per se is low, a phenomenon of thermal elongation and contraction is excellently executed in synchronism with other part, further, nickel is excellent in rust resistance and rich in malleability on which importance is given in forging. Further, although in working to form such a small structure, generally, a method of anisotropic etching is adopted, according to the method, a number of working steps is increased and therefore, the method is disadvantageous in view of fabrication cost. In contrast thereto, when the above-described forging method is used in a material of nickel or the like, a number of working steps is considerably reduced, which is extremely advantageous in view of cost.

As shown by a two-dotted chain line of FIG. 27 or FIG. 29 or FIG. 4, by working the groove-like recess portion 33 and the reference hole 73 as proximate as possible, an amount of displacing the position of the reference hole 73 by a change in temperature can be minimized and integration accuracy can further be promoted. That is, an amount of the metal material 55 (plate-like member, pressure generating chamber forming plate or the like) between the groove-like recess portion 33 and the reference hole 73 is reduced and therefore, an amount of changing the relative positions of the groove-like recess portion 33 and the reference hole 73 by the temperature change is reduced to an unproblematic level, the groove-like recess portion 33 is correctly communicated with, for example, the ink supply port 45 of the elastic plate 32 and accurate integration quality is achieved.

The method of fabricating the liquid ejection head 1 according to the embodiment constitutes an object of fabrication by a constitution including the pressure generating chamber forming plate 30 made of a metal aligned with the groove-like recess portion 33 constituting the pressure generating chamber 29 and formed with the communication port 34 penetrated in the plate thickness direction at one end of each groove-like recess portion 33, the nozzle plate 31 made of a metal bored with the nozzle opening 48 at a position in correspondence with the communication port 34, and the sealing plate made of a metal for sealing the opening face of the groove-like recess portion 33 and bored with the ink supply port 45 at a position in correspondence with other end of the groove-like recess portion 33, in which the sealing plate (43) is bonded to the side of the groove-like recess portion 33 of the pressure generating chamber forming plate 30 and the nozzle plate 31 is bonded to the opposed side, respectively.

Forming of the groove-like recess portion 33 and forming of the reference hole 73 for positioning the pressure generating chamber forming plate 30 at the pressure generating chamber forming plate 30 integrated to the liquid ejection head 1 are carried out in the same working stage.

Therefore, the groove-like recess portion 33 and the reference hole 73 are formed in the same working stage while setting the pressure generating chamber forming plate 30 in the forging machine and therefore, the relative positions of the groove-like recess portion 33 and the reference hole 73 are correctly provided. That is, the plurality of kinds of dies mounted to the forging machine are successively fed to be pressed to the pressure generating chamber forming plate 30 brought into the stationary state simultaneously or successively and therefore, the pressure generating chamber forming plate 30 is not moved during the time period of forming the groove-like recess portion 33 and the reference hole 73, the positional relationship among the respective forming parts can accurately be set, and the liquid ejection head 1 excellent in integration accuracy can be fabricated while maintaining the high forming accuracy of the groove-like recess portion 33. Further, meaning of "working stage" is the same as that described above.

Further, by fabricating the pressure generating chamber forming plate 30 by nickel, the linear expansion coefficients of the pressure generating chamber forming plate 30, the elastic plate 32 and the nozzle plate 31 constituting the flow path unit 4 are substantially made to be equal and therefore, when the respective members are heated and adhered, the respective members are uniformly expanded. Therefore, mechanical stresses of warp and the like caused by the difference in the expansion coefficients are difficult to be generated. As a result, even when the adhering temperature is set to a high temperature, the respective members can be adhered without a hindrance. Further, even when the piezoelectric oscillator generates heat in operating the recording head and the flow path unit 4 is heated by the heat, the respective members constituting the flow path unit 4 are uniformly expanded. Therefore, even when heating in accordance with operating the recording head and cooling by stopping to operate the recording head are repeatedly carried out, a drawback of exfoliating the respective members constituting the flow path unit 4 is difficult to be brought about.

Although in the above-described explanation, an explanation has been given by taking an example of the case in which boring is carried out in the state of lowering the male die 51 by the maximum stroke, and the worked portion worked in the working stage the same as that of the groove-like recess portion 33 is the integrating reference hole 73, in the worked portion, also the pilot hole 72 for working the communication port is bored in the state of boring the male die 51 by the maximum stroke similar to the integrating reference hole 73 and is worked in the working stage the same as that of the groove-like recess portion 33. Thereby, also the communication port working pilot hole 72 can ensure the highly accurate positional relationship relative to the groove-like recess portion 33, and the communication port can be bored with high accuracy in the third step thereafter.

In this way, the embodiment is applicable also to a case in which there are a plurality of kinds of worked portions worked in the state of lowering the male die 51 by the maximum stroke and worked by the working stage the same as that of the groove-like recess portion 33, and the plurality of kinds of worked portions are worked substantially simultaneously. Thereby, for example, respectives of the worked portions having functions different from each other can be worked while ensuring the highly accurate positional relationship among the small worked portions.

Figure 23:
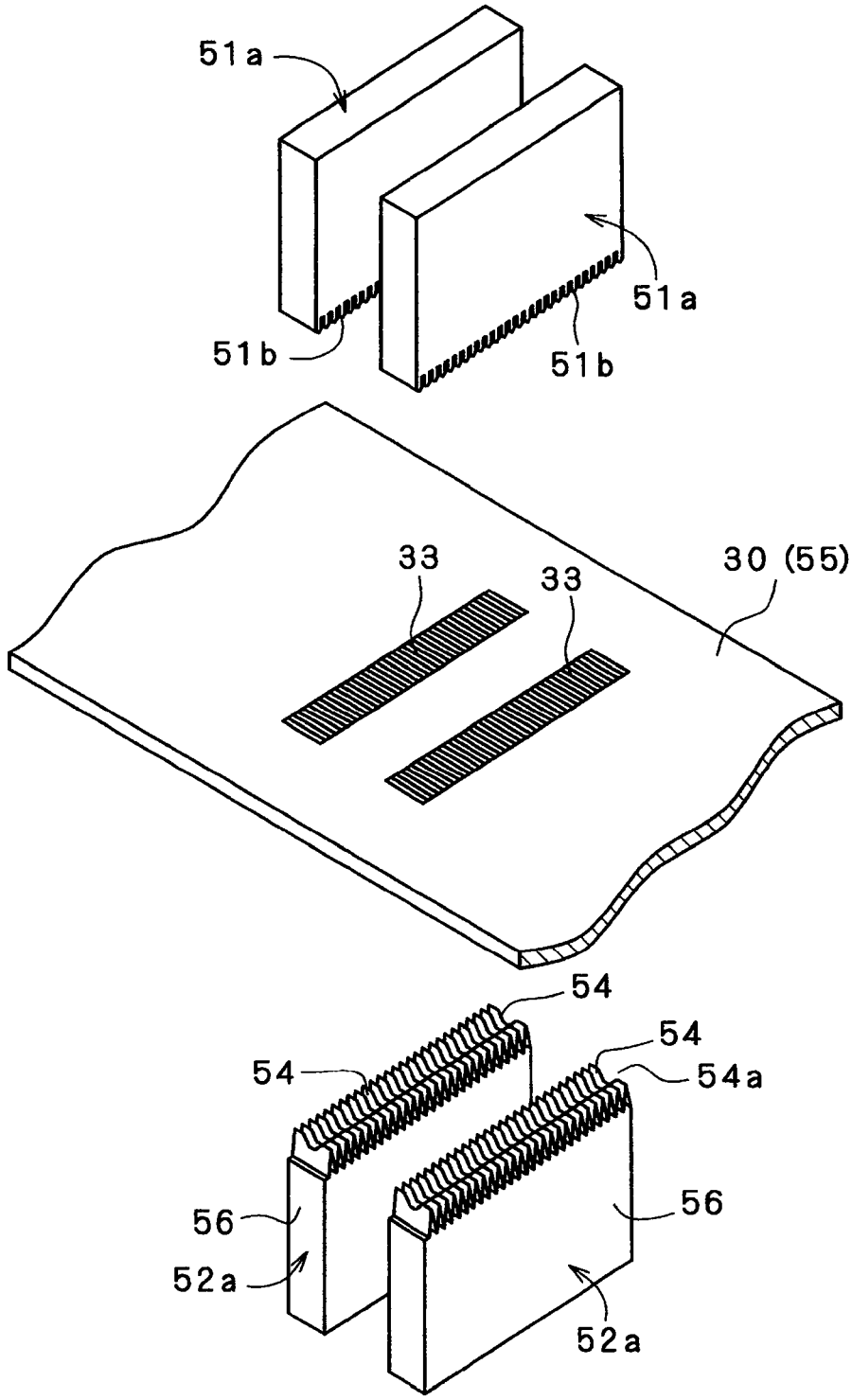
FIG. 23 is a perspective view showing a relationship between dies and a material.

According to the above-described embodiment, as shown by FIG. 18, FIG. 23, FIG. 24 or the like, the streak-like projection 54 is opposed to the projected streak portion 53, 53*c*. In order to facilitate to understand the states, FIG. 30 shows the positional relationship between the projected streak portion 53, 53*c* and the streak-like projection 54.

Figure 30:
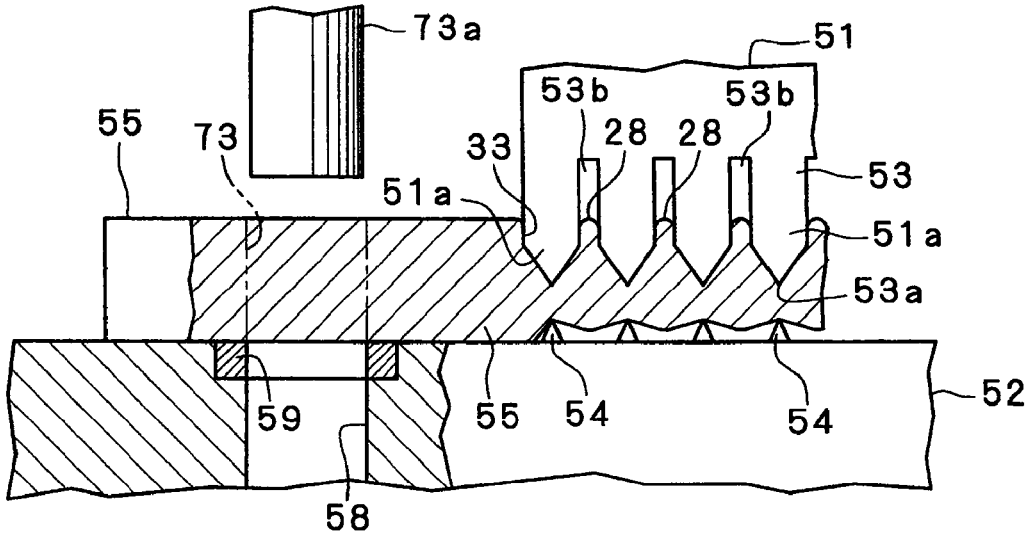
FIG. 30 illustrates sectional views showing to enlarge a forming procedure.
Figure 30:
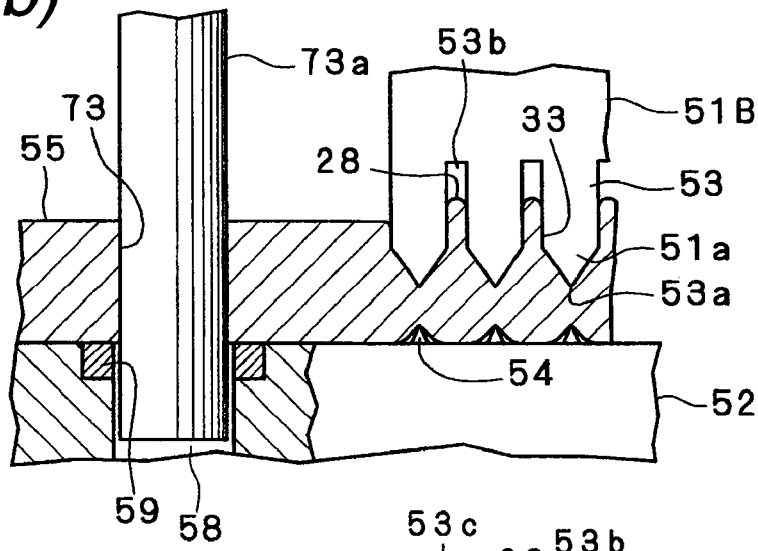
Figure 30:
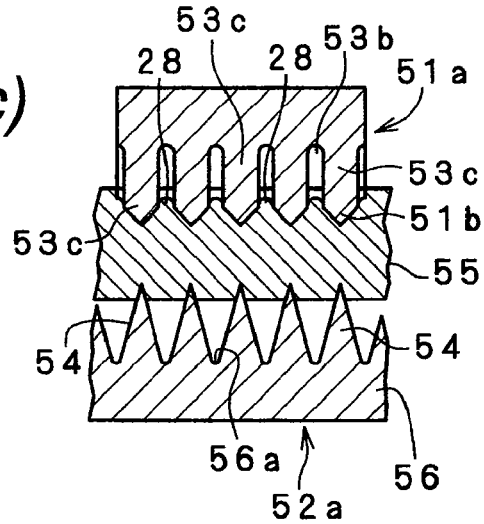

FIG. 30(*c*) shows a case of sharpening the streak-like projection 54 in the wedge-like shape and a phenomenon of plastic flow of the material is the same as that of FIGS. 30(*a*), (*b*).

Figure 31:
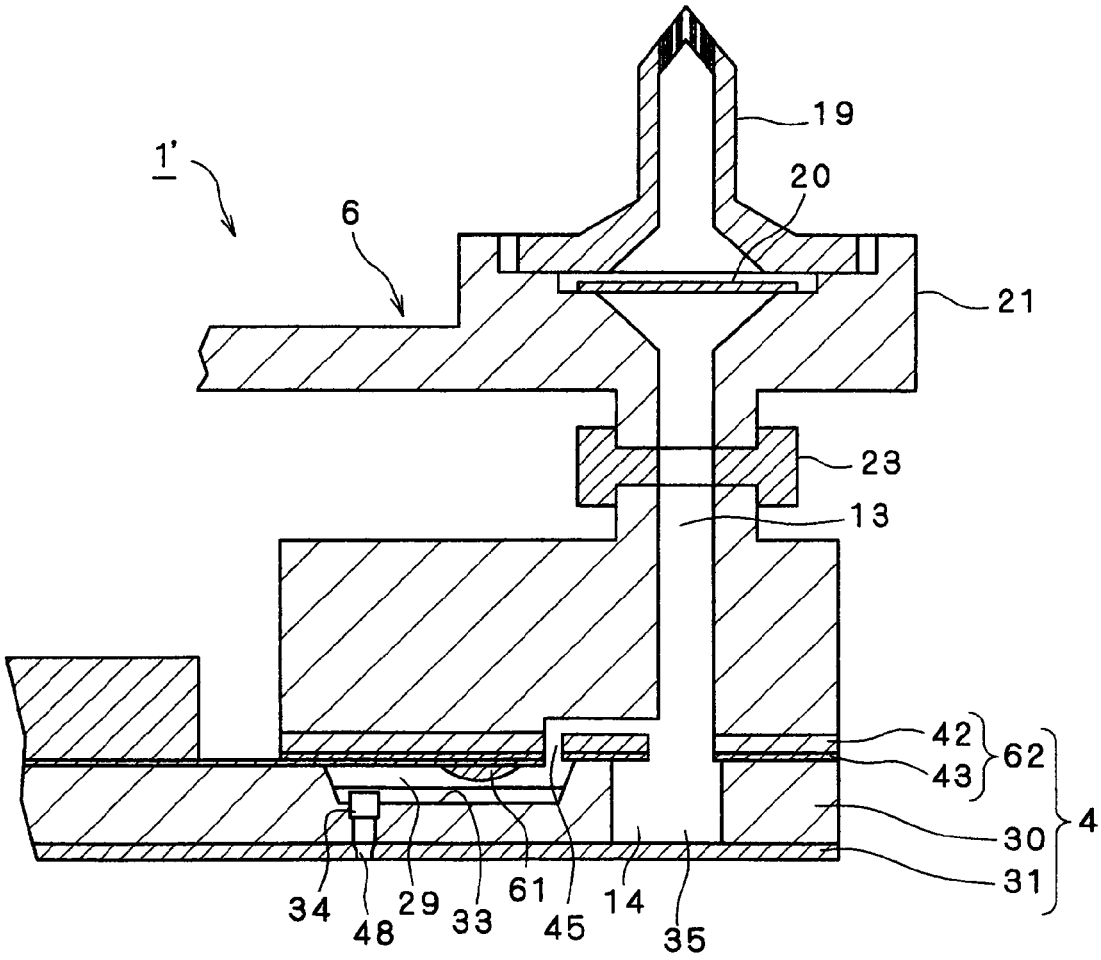
FIG. 31 is a sectional view for explaining a modified example of an ink jet type recording head.

The recording head 1' exemplified in FIG. 31 is a case to which the invention can be applied and a heat generating element 61 is used as a pressure generating element. According to the example, a sealing board 62 similar to the elastic plate 32 is used and the side of the groove-like recess portion 33 of the pressure generating chamber forming plate 30 is sealed by the sealing board 62. Further, according to the example, the heat generating element 61 is attached to a surface of the sealing board 62 in the pressure generating chamber 29. The heat generating element 61 is fed with electricity via an electric wire to generate heat. Further, other constitutions of the pressure generating chamber forming plate 30, the nozzle plate 31 and the like are similar to those of the above-described embodiment and therefore, an explanation thereof will be omitted.

According to the recording head 1', by feeding electricity to the heat generating element 61, ink in the pressure generating chamber 29 is bumped and air bubbles produced by the bumping pressurizes ink in the pressure generating chamber 29. Ink drops are ejected from the nozzle opening 48 by the pressurizing. Further, also in the recording head 1', the pressure generating chamber forming plate 30 is fabricated by plastic deformation of a metal and therefore, operation and effect similar to those of the above-described embodiment are achieved.

The working step according to the invention is limited to that shown in FIG. 8 or the like but a number of working steps can be increased or reduced, further, respective working stages can be reintegrated in correspondence with the increase or the reduction of the steps in consideration of a situation of a production step and a facility.

Further, with regard to the communication port 34, although in the above-described embodiment, an explanation has been given of an example of providing the communication port 34 at one end portion of the groove-like recess portion 33, the embodiment is not limited thereto. For example, the ink supply port 45 and the common ink chamber 14 communicate therewith may be arranged at the both ends in the longitudinal direction of the groove-like recess portion 33. Thereby, stagnation of ink in the pressure generating chamber 29 reaching the communication port 34 from the ink supply port 45 can be prevented and therefore, the constitution is preferable.

Although the above-described respective embodiments constitute an object by the ink jet type recording apparatus, the method of working the small recess portion and the method of fabricating the ink ejection head according to the invention may not constitute an object only by ink for the ink jet type recording apparatus but glue, manicure, a conductive liquid (liquid metal) or the like can also be ejected. Further, although according to the above-described embodiment, an explanation has been given of the ink jet type recording head using ink as one of liquids, the embodiment is also applicable generally to liquid ejection heads for ejecting liquids of a recording head used in an image recording apparatus of a printer or the like, a colorant ejecting head used in fabricating a color filter of a liquid crystal display or the like, an electrode material ejecting head used in forming an electrode of an organic EL display, FED (face light emitting display) or the like, or an organic living body ejecting head used for fabricating a biochip or the like.

What is claimed is:

1. A liquid ejection head comprising:

a pressure generating chamber forming plate that is made of a metal, that is formed with groove-like recess portions each of which extends in a first direction and which are aligned in two lines extending in a second direction perpendicular to the first direction and that is formed with communication ports penetrated in a plate thickness direction at one ends of the groove-like recess portions;

a nozzle plate that is made of a metal, that is bored with nozzle openings at positions thereof in correspondence with the communication ports; and a sealing plate that is made of a metal, that is for sealing opening faces of the groove-like recess portions and that is bored with liquid supply ports at positions thereof in correspondence with other ends of the groove-like recess portions, wherein:

the liquid ejection head is constituted by bonding the sealing plate to a side of the pressure generating chamber forming plate where the groove-like recess portions are formed, and also bonding the nozzle plate to an opposite side of the pressure generating chamber forming plate; and the pressure generating chamber forming plate is formed with a groove extending in the second direction between the two lines, the groove has a first portion and a second portion therein, and the first portion has a higher rigidity than the second portion.

2. The liquid ejection head according to claim 1, wherein the first portion is disposed at a predetermined portion at a vicinity of an imaginary line extending in the second direction along end portions of the groove-like recess portions.

3. The liquid ejection head according to claim 1, wherein the first portion is a narrow width portion formed by narrowing a width of a portion of the groove.

4. The liquid ejection head according to claim 1, wherein the first portion is greater than the second portion in height in the plate thickness direction.

5. The liquid ejection head according to claim 1, wherein the second portion has an opening portion.

* * * * *